US012807390B2

(12) United States Patent
Zachrich et al.

(10) Patent No.: US 12,807,390 B2
(45) Date of Patent: Nov. 24, 2026

(54) INSULATING CONTAINER

(71) Applicant: Dometic Sweden AB, Solna (SE)

(72) Inventors: Christian Zachrich, Bromma (SE); Herman Sebastian Cousin Espinosa, Katy, TX (US); Jim Verespej, Katy, TX (US); Vernon A. Harrison, Jr., Sealy, TX (US); Jesus E. Linares, Fulshear, TX (US)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 19/042,652

(22) Filed: Jan. 31, 2025

(65) Prior Publication Data

US 2025/0250096 A1 Aug. 7, 2025

Related U.S. Application Data

(60) Provisional application No. 63/549,153, filed on Feb. 2, 2024.

(51) Int. Cl.
*B65D 81/38* (2006.01)
*B65D 25/08* (2006.01)
(Continued)

(52) U.S. Cl.
CPC ..... *B65D 81/3823* (2013.01); *B65D 25/08* (2013.01); *B65D 25/2852* (2013.01);
(Continued)

(58) Field of Classification Search
CPC ..... B65D 43/164; B65D 2251/1058; B65D 81/3823; B65D 25/08; B65D 25/2852;
(Continued)

(56) References Cited

U.S. PATENT DOCUMENTS 9,139,352 B2 9/2015 Seiders et al.
9,462,796 B1 * 10/2016 Ellis ..... A47C 7/62
(Continued)

FOREIGN PATENT DOCUMENTS

AU 2021221680 A1 3/2023
CN 106800142 A 6/2017
(Continued)

OTHER PUBLICATIONS

Design U.S. Appl. No. 29/988,045 titled "Insulated Container" filed Jan. 29, 2025.

(Continued)

*Primary Examiner* — Shawn M Braden
(74) *Attorney, Agent, or Firm* — Dinsmore & Shohl LLP

(57) ABSTRACT

An insulating container includes a plurality of walls defining an outer body member, a base member that supports the outer body member, a liner disposed within and spaced apart from the plurality of walls, and an internal cavity. A lid is releasably and pivotally coupled to the outer body member or a liner therein to move between an open position and a closed position. The lid is pivotable in both a first direction and a second direction opposite the first direction to move between closed positions and open positions. The insulating container further includes a latching assembly that releasably secures the lid to the outer body member. The latching assembly includes an upper latch member fixedly coupled to the lid, a lower latch member pivotable between a pivoting position and a release position.

22 Claims, 16 Drawing Sheets

(51) Int. Cl.

| | |
|---|---|
| ***B65D 25/28*** | (2006.01) |
| ***B65D 25/38*** | (2006.01) |
| ***B65D 43/16*** | (2006.01) |
| ***B65D 43/22*** | (2006.01) |
| ***B65D 53/02*** | (2006.01) |

(52) U.S. Cl.
CPC ..... *B65D 25/38* (2013.01); *B65D 43/167* (2013.01); *B65D 43/22* (2013.01); *B65D 53/02* (2013.01)

(58) Field of Classification Search
CPC ..... B65D 25/38; B65D 43/167; B65D 43/22; B65D 53/02; B65D 81/3818; F25D 3/08; F25D 21/14
See application file for complete search history.

(56) References Cited

U.S. PATENT DOCUMENTS

| | | | | |
|---|---|---|---|---|
| 9,902,548 | B2 | 2/2018 | Seiders et al. | |
| D820,049 | S | 6/2018 | Ahlström et al. | |
| 10,029,842 | B2 | 7/2018 | Seiders et al. | |
| D836,993 | S | 1/2019 | Meda et al. | |
| D887,788 | S | 6/2020 | Meda et al. | |
| 10,981,716 | B2 | 4/2021 | Seiders et al. | |
| 11,345,536 | B2 | 5/2022 | Luo | |
| 11,767,157 | B2 | 9/2023 | Seiders et al. | |
| 11,866,243 | B2 | 1/2024 | Birgersen et al. | |
| 12,012,275 | B2 | 6/2024 | Seiders et al. | |
| 2016/0272405 | A1* | 9/2016 | Furneaux | F25D 23/028 |
| 2018/0354687 | A1 | 12/2018 | Seiders et al. | |
| 2021/0284426 | A1* | 9/2021 | Kalajyan | B65D 81/3813 |
| 2022/0388722 | A1* | 12/2022 | Ahlström | B65D 25/2841 |
| 2022/0412632 | A1 | 12/2022 | Middleton | |
| 2024/0017907 | A1 | 1/2024 | Nixon et al. | |
| 2025/0242990 | A1* | 7/2025 | Roberts | B65D 45/20 |

FOREIGN PATENT DOCUMENTS

| | | | | |
|---|---|---|---|---|
| CN | 110228665 | A | 9/2019 | |
| CN | 211253708 | U | 8/2020 | |
| JP | H10211945 | A | 8/1998 | |
| TW | 112300187 | | 6/2023 | |
| WO | PCT/AU2022/051025 | * | 8/2022 | |
| WO | WO-2023023797 | A1 * | 3/2023 | F25D 3/10 |

OTHER PUBLICATIONS

U.S. Appl. No. 63/549,153 titled "Insulating Container" filed Feb. 2, 2024.
PCT Application No. PCT/IB2025/051090 titled "Insulating Container" filed Jan. 31, 2025.
Design U.S. Appl. No. 29/987,647 titled "Insulated Container" filed Jan. 24, 2025.
U.S. Appl. No. 63/549,139 titled "Insulating Container" filed Feb. 2, 2024.
PCT Application No. PCT/IB2025/051087 titled "Insulating Container" filed Jan. 31, 2025.
U.S. Appl. No. 19/042,561 titled "Insulating Container" filed Jan. 31, 2025.
Invitation to Pay Additional Fees and Partial Search Report for International Application No. PCT/IB2025/051090, mailed on May 7, 2025.
EU Design Application No. 015111100-0004 titled "Insulating boxes [household]" filed Jul. 17, 2025.
EU Design Application No. 015111100-0005 titled "Insulating boxes [household]" filed Jul. 17, 2025.
EU Design Application No. 015111100-0006 titled "Insulating boxes [household]" filed Jul. 17, 2025.
EU Design Application No. 015111100-0007 titled "Insulating boxes [household]" filed Jul. 17, 2025.
EU Design Application No. 015111100-0008 titled "Insulating boxes [household]" filed Jul. 17, 2025.
EU Design Application No. 015111100-0009 titled "Insulating boxes [household]" filed Jul. 17, 2025.
EU Design Application No. 015111100-0010 titled "Insulating boxes [household]" filed Jul. 17, 2025.
EU Design Application No. 015111100-0011 titled "Insulating boxes [household]" filed Jul. 17, 2025.
EU Design Application No. 015111100-0012 titled "Insulating boxes [household]" filed Jul. 17, 2025.
EU Design Application No. 015111100-0013 titled "Insulating boxes [household] (part of -)" filed Jul. 17, 2025.
EU Design Application No. 015111100-0014 titled "Insulating boxes [household] (part of -)" filed Jul. 17, 2025.
GB Design Application No. 6459488 titled "Insulated container" filed Jul. 22, 2025.
GB Design Application No. 6459489 titled "Insulated container" filed Jul. 22, 2025.
GB Design Application No. 6459490 titled "Insulated container" filed Jul. 22, 2025.
GB Design Application No. 6459491 titled "Insulated container" filed Jul. 22, 2025.
GB Design Application No. 6459492 titled "Insulated container" filed Jul. 22, 2025.
GB Design Application No. 6459493 titled "Insulated container" filed Jul. 22, 2025.
GB Design Application No. 6459494 titled "Insulated container" filed Jul. 22, 2025.
GB Design Application No. 6459495 titled "Insulated container" filed Jul. 22, 2025.
GB Design Application No. 6459496 titled "Insulated container" filed Jul. 22, 2025.
GB Design Application No. 6459497 titled "Insulated container" filed Jul. 22, 2025.
GB Design Application No. 6459498 titled "Insulated container" filed Jul. 22, 2025.
GB Design Application No. 6459499 titled "Insulated container" filed Jul. 22, 2025.
GB Design Application No. 6459500 titled "Cap for an Insulated Container" filed Jul. 22, 2025.
GB Design Application No. 6459501 titled "Cap for an Insulated Container" filed Jul. 22, 2025.
KH Design Application No. KH/D/2025/00074 titled "Insulated container" filed Jul. 29, 2025.
KH Design Application No. KH/D/2025/00075 titled "Insulated container" filed Jul. 29, 2025.
KH Design Application No. KH/D/2025/00076 titled "Insulated container" filed Jul. 29, 2025.
KH Design Application No. KH/D/2025/00077 titled "Cap for an Insulated Container" filed Jul. 29, 2025.
KH Design Application No. KH/D/2025/00078 titled "Cap for an Insulated Container" filed Jul. 29, 2025.
CN Design Application No. 202530431127.8 titled "Insulated container" filed Jul. 23, 2025.
CN Design Application No. 202530431123.X titled "Insulated container" filed Jul. 23, 2025.
CN Design Application No. 202530440748.2 titled "Insulated container" filed Jul. 28, 2025.
CN Design Application No. 202530440747.8 titled "Insulated container" filed Jul. 28, 2025.
CN Design Application No. 202530440751.4 titled "Insulated container" filed Jul. 28, 2025.
CN Design Application No. 202530440750.X titled "Insulated container" filed Jul. 28, 2025.
CN Design Application No. 202530440752.9 titled "Insulated container" filed Jul. 28, 2025.
EU Design Application No. 015110536-0001 titled "Insulation boxes [household use]" filed Jul. 14, 2025.
EU Design Application No. 015110536-0002 titled "Insulation boxes [household use]" filed Jul. 14, 2025.
EU Design Application No. 015110536-0003 titled "Insulation boxes [household use]" filed Jul. 14, 2025.

(56) References Cited

OTHER PUBLICATIONS

EU Design Application No. 015110536-0004 titled "Insulation boxes [household use]" filed Jul. 14, 2025.
EU Design Application No. 015110536-0005 titled "Insulation boxes [household use]" filed Jul. 14, 2025.
EU Design Application No. 015110536-0006 titled "Insulation boxes [household use]" filed Jul. 14, 2025.
EU Design Application No. 015110536-0007 titled "Insulation boxes [household use]" filed Jul. 14, 2025.
EU Design Application No. 015110536-0008 titled "Insulation boxes [household use]" filed Jul. 14, 2025.
EU Design Application No. 015110536-0009 titled "Insulation boxes [household use]" filed Jul. 14, 2025.
EU Design Application No. 015110536-0010 titled "Insulation boxes [household use]" filed Jul. 14, 2025.
EU Design Application No. 015110536-0011 titled "Insulation boxes [household use]" filed Jul. 14, 2025.
EU Design Application No. 015110536-0012 titled "Insulation boxes [household use]" filed Jul. 14, 2025.
AU Design Application No. 202515449 titled "Insulated container" filed Jul. 16, 2025.
AU Design Application No. 202515450 titled "Insulated container" filed Jul. 16, 2025.
AU Design Application No. 202515451 titled "Insulated container" filed Jul. 16, 2025.
AU Design Application No. 202515452 titled "Insulated container" filed Jul. 16, 2025.
AU Design Application No. 202515453 titled "Insulated container" filed Jul. 16, 2025.
AU Design Application No. 202515454 titled "Insulated container" filed Jul. 16, 2025.
GB Design Application No. 6459461 titled "Insulated container" filed Jul. 22, 2025.
GB Design Application No. 6459462 titled "Insulated container" filed Jul. 22, 2025.
GB Design Application No. 6459463 titled "Insulated container" filed Jul. 22, 2025.
GB Design Application No. 6459464 titled "Insulated container" filed Jul. 22, 2025.
GB Design Application No. 6459465 titled "Insulated container" filed Jul. 22, 2025.
GB Design Application No. 6459466 titled "Insulated container" filed Jul. 22, 2025.
GB Design Application No. 6459467 titled "Insulated container" filed Jul. 22, 2025.
GB Design Application No. 6459468 titled "Insulated container" filed Jul. 22, 2025.
GB Design Application No. 6459469 titled "Insulated container" filed Jul. 22, 2025.
GB Design Application No. 6459470 titled "Insulated container" filed Jul. 22, 2025.
GB Design Application No. 6459471 titled "Insulated container" filed Jul. 22, 2025.
GB Design Application No. 6459472 titled "Insulated container" filed Jul. 22, 2025.
KH Design Application No. KH/D/2025/00063 titled "Insulated container" filed Jul. 24, 2025.
KH Design Application No. KH/D/2025/00064 titled "Insulated container" filed Jul. 24, 2025.
KH Design Application No. KH/D/2025/00065 titled "Insulated container" filed Jul. 24, 2025.
AU Design Application No. 202515495 titled "Insulated container" filed Jul. 17, 2025.
AU Design Application No. 202515496 titled "Insulated container" filed Jul. 17, 2025.
AU Design Application No. 202515497 titled "Insulated container" filed Jul. 17, 2025.
AU Design Application No. 202515498 titled "Insulated container" filed Jul. 17, 2025.
AU Design Application No. 202515499 titled "Insulated container" filed Jul. 17, 2025.
AU Design Application No. 202515500 titled "Insulated container" filed Jul. 17, 2025.
AU Design Application No. 202515501 titled "Insulated container" filed Jul. 17, 2025.
AU Design Application No. 202515502 titled "Insulated container" filed Jul. 17, 2025.
AU Design Application No. 202515503 titled "Insulated container" filed Jul. 17, 2025.
AU Design Application No. 202515504 titled "Insulated container" filed Jul. 17, 2025.
AU Design Application No. 202515505 titled "Insulated container" filed Jul. 17, 2025.
AU Design Application No. 202515506 titled "Insulated container" filed Jul. 17, 2025.
AU Design Application No. 202515507 titled "Cap for an insulated container" filed Jul. 17, 2025.
AU Design Application No. 202515508 titled "Cap for an insulated container" filed Jul. 17, 2025.
EU Design Application No. 015111100-0001 titled "Insulating boxes [household]" filed Jul. 17, 2025.
EU Design Application No. 015111100-0002 titled "Insulating boxes [household]" filed Jul. 17, 2025.
EU Design Application No. 015111100-0003 titled "Insulating boxes [household]" filed Jul. 17, 2025.
CFX Electric Cooler, Dometic, customer review oldest date May 22, 2024 [online], [site visited Feb. 12, 2026], available from the internet URL: https://www.amazon.com/dp/B083V72TRV (Year: 2024).
AU Design Application No. 2025215275 titled "Insulating Container" filed Aug. 7, 2026.
CN Patent Application No. 202580018183.6 titled "Insulating Container" filed Aug. 31, 2026.
DE Patent Application No. 112025000470.1 titled "Insulating Container" filed Aug. 27, 2026.

* cited by examiner

INSULATING CONTAINER

INCORPORATION BY REFERENCE

Any and all applications to which a foreign and/or domestic priority is claimed are identified in the Application Data Sheet filed with the present application, are hereby incorporated by reference herein, and are made a part of the present disclosure.

TECHNICAL FIELD

The present specification generally relates to insulated containers and, more specifically, to latching assemblies for insulating containers.

BACKGROUND

Traditional insulating containers, such as coolers, typically include a lid that is hinged at one end, thereby allowing the lid to open only in a single direction. The basic latching mechanisms employed by these traditional containers may limit the accessibility and flexibility of the container, particularly in circumstances in which the container is utilized in a cramped space or placed against a surface. Furthermore, cleaning and maintenance of traditional insulating containers can be challenging based on the fixed nature of standard lids. Accordingly, a need exists for an insulating container that provides enhanced accessibility and convenience in terms of access and use.

SUMMARY

The present application discloses one or more of the features recited in the appended claims and/or the following features which alone or in any combination, may comprise patentable subject matter.

In embodiments, an insulating container is disclosed. In these embodiments, the insulating container includes a plurality of walls defining an outer body member, a base member that supports the outer body member, a liner disposed within and spaced apart from the plurality of walls, and an internal cavity defined by the liner. A lid is releasably and pivotally coupled to the outer body member to move between an open position in which the internal cavity is accessible and a closed position in which the lid forms a seal with the liner. The lid is pivotable in a first direction and a second direction opposite the first direction to move from the closed position to the open position. The insulating container further includes a latching assembly that releasably secures the lid to the outer body member. The latching assembly includes an upper latch member fixedly coupled to the lid, a lower latch member pivotable between a pivoting position and a release position, and a pin member that couples the upper latch member to the lower latch member. A knuckle is fixedly attached to the outer body member and extends between the outer body member and the liner, the knuckle including a seat for receiving the pin member of the latching assembly.

In other embodiments, an insulating container is disclosed. The insulating container includes a plurality of walls defining a rigid outer body member, a rigid base member that supports the outer body member, a liner disposed within and spaced apart from the plurality of walls, an internal cavity defined by the liner of the insulating container. A lid is releasably and pivotally coupled to the rigid outer body member to move between an open position in which the internal cavity of the insulating container is accessible and a closed position in which the lid forms a seal with the liner. The insulating container further includes a first latching assembly and a second latching assembly that releasably secure the lid to the rigid outer body member, the first latching assembly and the second latching assembly each including an upper latch member fixedly coupled to the lid, a lower latch member pivotable between a pivoting position and a release position, and a pin member that couples the upper latch member to the lower latch member, with the upper latch member being pivotable relative the pin member. The insulating container further includes a plurality of knuckles fixedly attached to the outer body member and extending between the outer body member and the liner, each of the plurality of knuckles including a seat for receiving the pin member of each of the first latching assembly and the second latching assembly. When the lower latch member of the first latching assembly is in the pivoting position and the lower latch member of the second latching assembly is in the release position, the lid pivots relative the first latching assembly between the open position and the closed position.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and figures, included herewith. A more extensive presentation of features, details, utilities, and advantages of the present teaching is provided in the following written description of various embodiments, illustrated in the accompanying figures, and defined in the appended claims.

BRIEF DESCRIPTION OF THE FIGURES

The embodiments set forth in the figures are illustrative and exemplary in nature and not intended to limit the subject matter defined by the claims. The following detailed description of the illustrative embodiments can be understood when read in conjunction with the following figures, where like structure is indicated with like reference numerals and in which:

DETAILED DESCRIPTION

Figure 1:
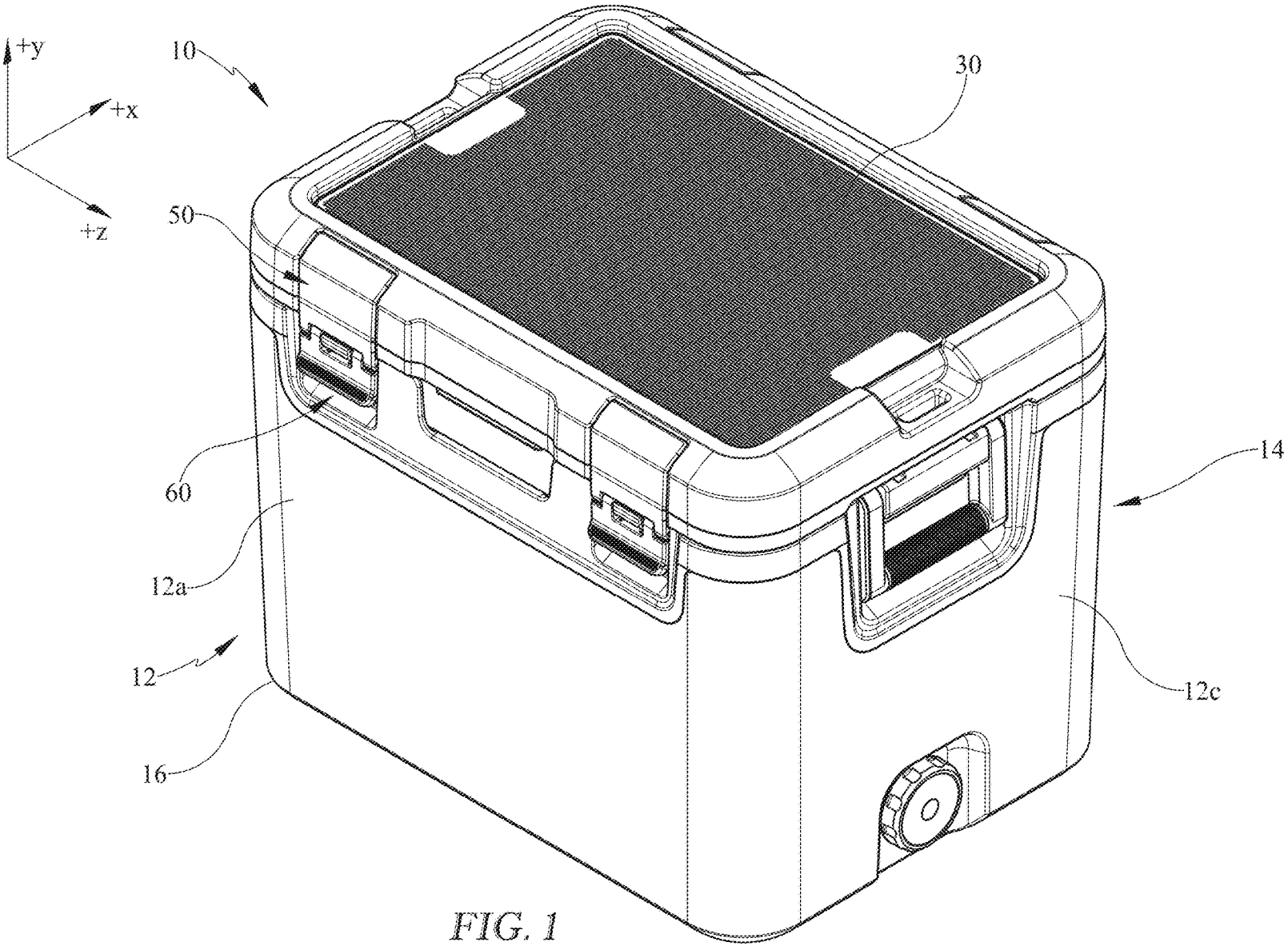
FIG. 1 schematically depicts a front-side perspective view of an insulating container, according to one or more embodiments shown and described herein.

Embodiments described herein are generally directed to insulating containers and various accessories for insulating containers. In these embodiments, the insulating container may include a plurality of walls that define an outer body member, a base member configured to support the outer body member, a liner disposed within the outer body member and defining an internal cavity, and a lid releasably and pivotally coupled to the outer body member. Furthermore, the lid may be coupled to the outer body member such that the lid is movable between an open position, in which the internal cavity of the insulating container is accessible, and a closed position, in which the lid forms a seal with the outer body member. In these embodiments, the lid may be further pivotable in a first direction and a second direction opposite the first direction to move the lid from the closed position to the open position.

The insulating container described herein may further include a latching assembly, which may be configured to releasably secure the lid to the outer body member and allow the lid to pivot in the first direction and the second direction from two opposed sides of the outer body member. The latching assembly may include an upper latch member fixedly coupled to the lid, a lower latch member pivotable between a pivoting position and a release position, and a pin member that couples the upper latch member to the lower latch member. In these embodiments the pin member may be received by a knuckle fixedly attached to the outer body member. The latching assembly described herein may allow the lid to move to the open position by pivoting in either the first direction or the second direction, and may further allow for the lid to be fully detached from the outer body member.

As described herein, conventional insulating containers, such as coolers, feature an outer structure (e.g. box-like or otherwise) including an insulated body and a lid. In these conventional containers, the lid may be hingedly coupled to the outer structure, such that the lid may open in a single direction. Despite their widespread use, these traditional containers restrict access to the insulated body, and can be difficult to clean and/or maintain. The insulating container described herein addresses these shortcomings by utilizing a latching assembly that allows for the lid to be pivoted in a first direction or a second direction relative the outer body member or fully removed from the outer body member, thereby providing enhanced adaptability and accessibility.

It is to be further understood that a "container," as described herein, is not limited in its application to the details of construction and the arrangement of components set forth in the following description or illustrated in the figures. The described embodiments are capable of other embodiments and of being practiced or of being carried out in various ways. Also, it is to be understood that the phraseology and terminology used herein is for the purpose of description and should not be regarded as limiting.

The use of "including," "comprising," or "having" and variations thereof herein is meant to encompass the items listed thereafter and equivalents thereof as well as additional items. Unless limited otherwise, the terms "connected," "supported," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present teaching. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Relative terminology, such as, for example, "about," "approximately," "substantially," etc., used in connection with a quantity or condition would be understood by those of ordinary skill to be inclusive of the stated value and has the meaning dictated by the context, for example, the term includes at least the degree of error associated with the measurement accuracy, tolerances (for example, manufacturing, assembly, use, etc. associated with the particular value. Such terminology should also be considered as disclosing the range defined by the absolute values of the two endpoints. For example, the expression "from about 2 to about 4" also discloses the range "from 2 to 4". The relative terminology may refer to plus or minus a percentage (for example, 1%, 5%, 10%) or more, of an indicated value.

Various embodiments of autonomous insulating containers and accessories for insulating containers will now be described herein. Whenever possible, the same reference numerals will be used throughout the figures to refer to the same or like parts.

Figure 2:
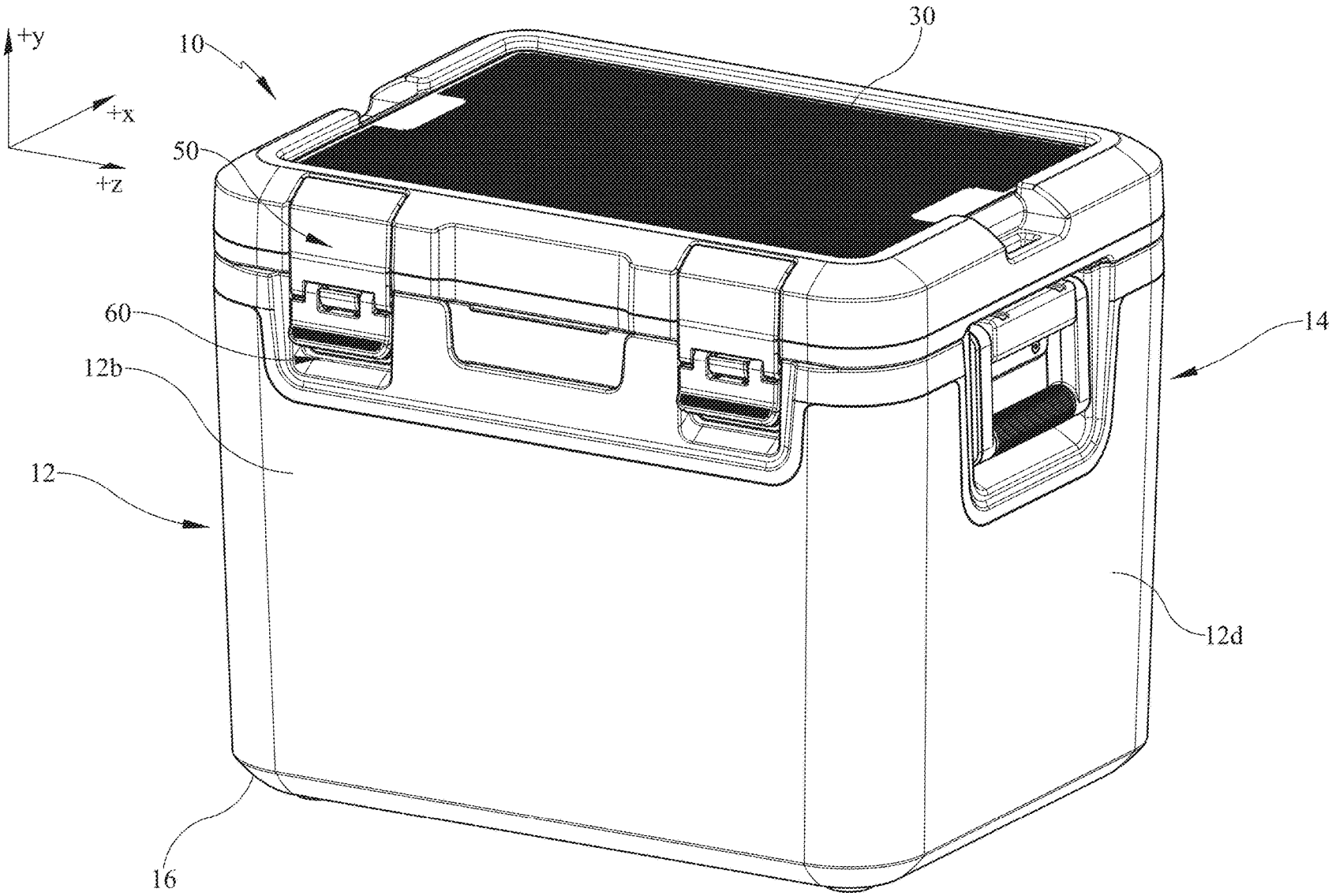
FIG. 2 schematically depicts a back-side perspective view of the insulating container of FIG. 1, according to one or more embodiments shown and described herein.
Figure 3:
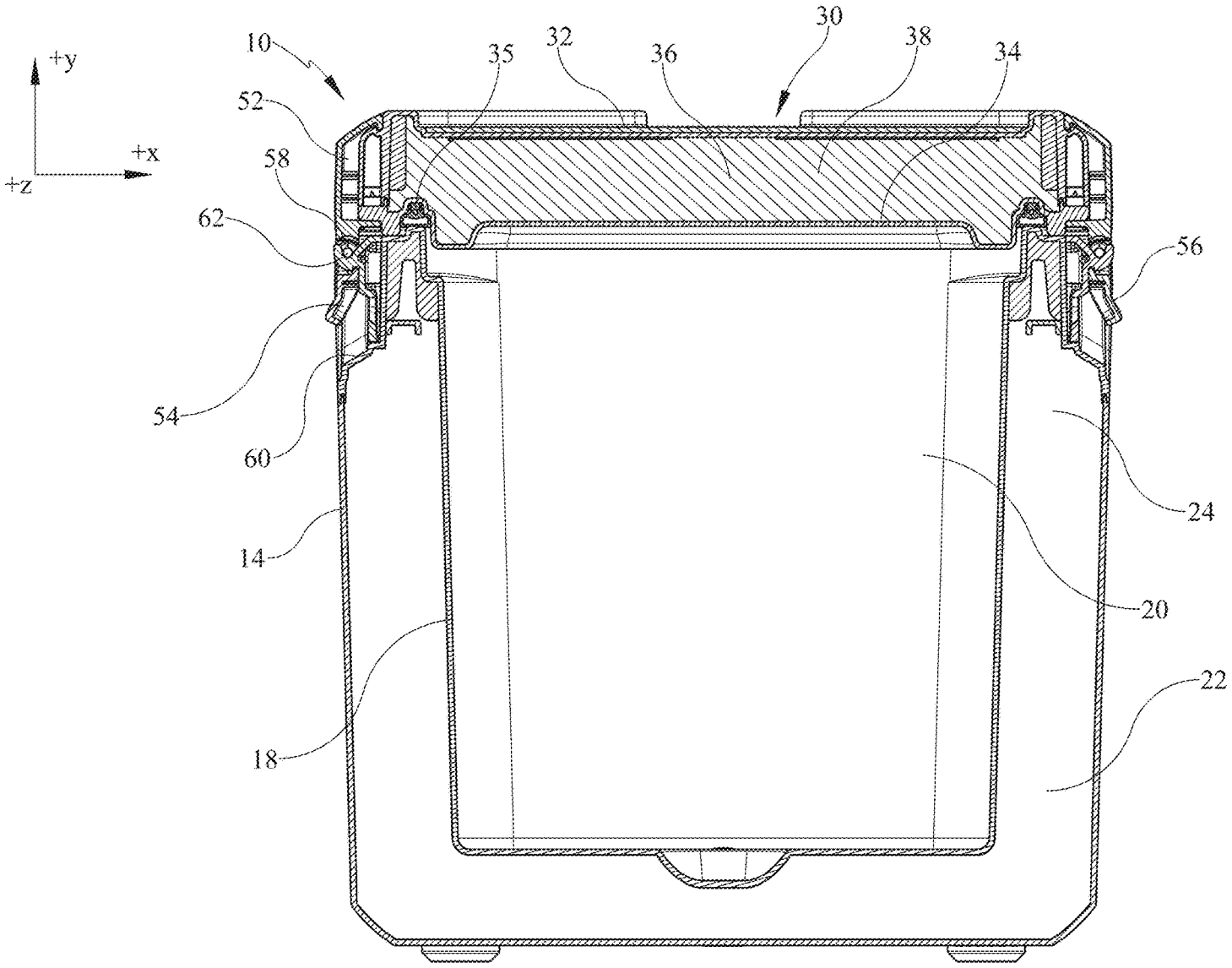
FIG. 3 depicts a cross-sectional view of the insulating container depicted in FIG. 1, according to one or more embodiments shown and described herein.

Referring now to FIGS. 1-3, an insulating container 10 is depicted. As illustrated in FIGS. 1 and 2, the insulating container 10 may include a plurality of walls 12 that define an outer body member 14 and a base member 16 configured to support the outer body member 14. In the embodiments depicted in FIGS. 1 and 2, the plurality of walls 12 may extend vertically from the base member 16 (e.g., in the +y-direction as depicted in the coordinate axes of FIGS. 1 and 2).

In the embodiments depicted in FIGS. 1-3, the plurality of walls 12 may include a first wall 12*a*, such as a front wall, a second wall 12*b*, such as a rear wall, and a pair of sidewalls 12*c*, 12*d* extending between the first wall 12*a* and the second wall 12*b*, such that the outer body member 14 may have a generally square or rectangular shape. For example, the outer body member 14 may have a rectangular shape when the first and second wall 12*a*, 12*b* have a length that is longer than a length of the pair of sidewalls 12*c*, 12*d*, or vice versa. Similarly, the outer body member 14 may have a square shape when each of the first wall 12*a*, second wall 12*b*, and the pair of sidewalls 12*c*, 12*d* have an equal length. Although the insulating container 10 is depicted as including four walls, it should be further appreciated that the insulating container 10 may include any number of walls without departing from the scope of the present disclosure.

Furthermore, in the embodiments described herein, the plurality of walls 12 may be manufactured from a number of rigid materials, such as plastic, aluminum, stainless steel, copper, or any other similar material, such that the outer body member 14 defined by the plurality of walls 12 is a rigid, or hard-shelled, outer body member 14. It should be further understood that, in some embodiments, the plurality of walls 12 may be formed as a single, monolithic structure (e.g., via injection molding, blow molding, rotomolding, etc.), or may be formed as separate components that are fixedly attached during manufacturing of the insulating container.

Referring still to FIGS. 1-3, the insulating container 10 may further include a liner 18 disposed within the plurality of walls 12 that defines an internal cavity 20 within the insulating container 10. In these embodiments, food, drink contents and/or other materials may be stored within the internal cavity 20 of the insulating container 10, and the internal cavity 20 may be configured to maintain the materials stored within the internal cavity 20 at a desired temperature.

In the embodiments described herein, the liner 18 may be spaced apart from the plurality of walls 12, such that a void 22 is formed between the outer body member 14 defined by the plurality of walls 12 and the liner 18, as illustrated most clearly in FIG. 3. In these embodiments, the void 22 formed between the outer body member 14 and the liner 18 may be filled with an insulation material 24, which may be configured to insulate the internal cavity 20 of the insulating container 10 from an external environment in order to aid in maintaining the desired temperature of the materials stored within the internal cavity 20. For example, the insulation material 24 may include, but are not limited to, an insulation foam (e.g., polyurethane, polystyrene, etc.), fiberglass, aerogel, natural insulation material (e.g., wool, cotton, etc.), or any other similar material. It should be appreciated that, in the embodiments described herein, the insulation material 24 deposited in the void 22 may be determined based on the requirements of the insulating container 10, such as desired temperature maintenance, expected environmental conditions, weight, durability, cost, and other similar factors.

In these embodiments, it should be appreciated that the liner 18 and the outer body member 14 may be formed separately or as a single, monolithic structure. For example, in embodiments in which the liner 18 and the outer body member 14 are formed separately, the insulation material 24 may be disposed on and/or secured to an inner surface of the outer body member 14. With the insulation material 24 disposed in the outer body member 14, the liner 18 may be installed. However, in embodiments in which the liner 18 and the outer body member 14 are formed as a single, monolithic structure, the void 22 formed between the liner 18 and the outer body member 14 may include an opening through which the insulation material 24 may be provided.

Referring still to FIGS. 1-3, the insulating container 10 may also include a lid 30. In these embodiments, the lid 30 may be releasably and pivotally coupled to the outer body member 14, such that the lid 30 may be translated from a closed position to an open position and/or detached from the outer body member 14. Furthermore, in the embodiments described herein, the lid 30 may be moved from the closed position to the open position by pivoting the lid in a first direction or a second direction opposite the first direction. Translation and release of the lid 30 will be described in additional detail herein with reference to FIGS. 5A-5C.

It should be appreciated that, in some embodiments, the lid 30 may be further and/or alternatively secured to the liner 18 of the insulating container 10. For example, in some embodiments, the liner 18 may extend above (e.g., in the +y-direction as depicted in the coordinate axis of FIG. 3) and radially outward about (e.g., in the +/−x-direction as depicted in the coordinate axis of FIG. 3) an upper surface of the outer body member 14, such that the upper surface of the outer body member 14 may be surrounded by and/or covered by the liner 18. Accordingly, in these embodiments, when the lid 30 is moved from the open position to the closed position, the lid 30 may directly contact at least a portion of the liner 18 rather than an upper surface of the outer body member 14.

Referring still to FIGS. 1-3, the lid 30 may be a rigid and/or hard-shelled structure formed of the same and/or similar material to the outer body member 14. Furthermore, it should be appreciated that the lid 30 may be formed of a single, monolithic structure, or be formed of multiple structures similar to the outer body member 14. For example, as depicted in FIG. 3, the lid 30 may include a lid shell 32, a lid liner 34, and a lid void 36 formed between the lid shell 32 and the lid liner 34.

In these embodiments, the lid shell 32 may define an exterior surface of the lid 30, while the lid liner 34 may be configured to engage with the outer body member 14 and/or liner 18 in order to seal the internal cavity 20 from the external environment, as will be described in additional detail herein. Furthermore, lid insulation material 38 may be disposed in the lid void 36 formed between the lid shell 32 and the lid liner 34, and may be further configured to aid in insulating the internal cavity 20 of the insulating container 10. It should be appreciated that the lid insulation material 38 disposed within the lid void 36 may include the same and/or different material from the insulation materials 24 disposed in the void 22 formed between the outer body member 14 and the liner 18.

Referring still to FIG. 3, in these embodiments, the lid 30 may further include a coating, such as a non-skid coating, which may be overmolded and/or otherwise disposed over a top surface of the lid 30 (e.g., about the lid shell 32). In these embodiments, the coating may be a TPE coating, rubberized coating, epoxy coating, polyurethane coating, acrylic coating, textured plastic coating, or any other similar coating capable of providing the lid 30 with a non-skid surface. It should be appreciated that, in these embodiments, the non-skid coating of the lid 30 may reduce the risk of slip and fall incidents (e.g., if the insulating container 10 is used as a seat and/or standing platform), increase durability of the lid, and provide additional stability for items placed on the lid 30 (e.g., cups, plates, other equipment, etc.), which may be particularly beneficial when the insulating container 10 is utilized in moving environments (e.g., boats, moving vehicles, etc.). Furthermore, in the embodiments described herein, the non-skid coating may further aid in enhancing the weather resistance of the lid 30, which may aid in increasing the durability of the insulating container 10 when used outdoors. Additionally, it should be understood that a lid material may be removably placed on the lid upper surface to provide the above advantages. Accordingly, the coating may be permanently applied, or a mat material may be removably positioned on the lid.

Figure 4A:
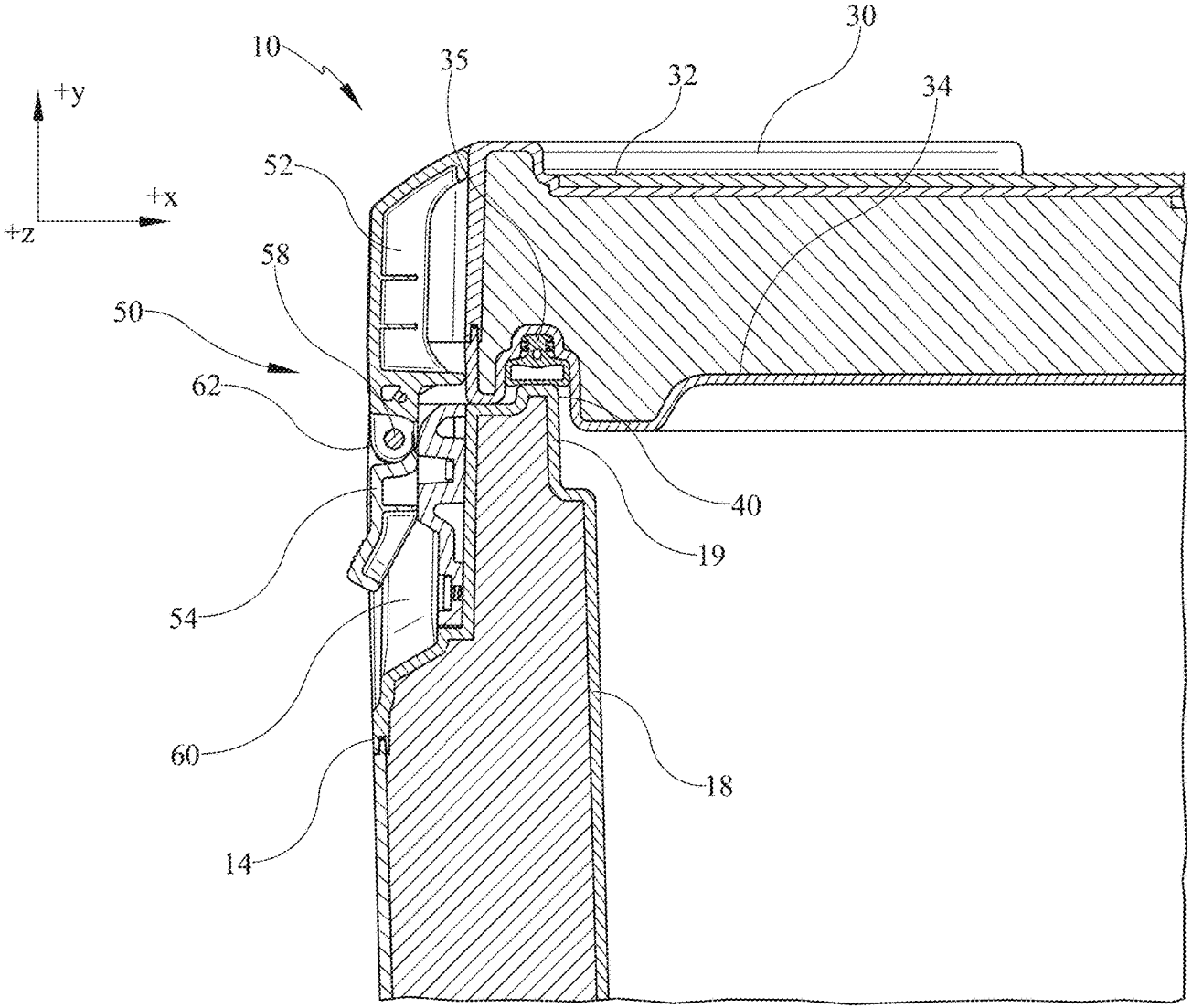
FIG. 4A depicts a cross-sectional view of a latching assembly of the insulating container of FIG. 1, according to one or more embodiments shown and described herein.

Referring still to FIG. 3, when the lid 30 is in the closed position, the lid 30 may form a seal 40 with the liner 18 defining the internal cavity 20 in order to more effectively insulate the materials stored within the internal cavity 20. For example, in these embodiments, the lid liner 34 may further include a gasket 35, which may be configured to engage a sealing surface 19 (FIG. 4) formed on an upper portion of the liner 18. In these embodiments, when the lid 30 is moved to the closed position, the gasket 35 formed on the lid liner 34 may contact the sealing surface 19 of the liner 18. As the gasket 35 is compressed between the lid 30 and the liner 18, the gasket 35 may deform such that the seal 40 is formed between the gasket 35 and the sealing surface 19 of the liner 18. In these embodiments, the seal 40 formed between the gasket 35 and the sealing surface 19 of the liner 18 may be an air-tight or water-tight seal that prevents an exchange of air between the internal cavity 20 of the container and an outside environment, which may aid in regulating temperature within the internal cavity 20. Furthermore, the gasket 35 may act as a thermal barrier, which further insulates the contents of the internal cavity from temperature changes attributable to the outside environment. In the embodiments described herein, the gasket 35 may be formed of a single material or combination of materials consisting of rubber, silicone, foam, or any other similarly flexible and/or resilient material capable of forming the seal 40 with the sealing surface 19 of the liner 18.

Although the gasket 35 is depicted as being disposed on the lid liner 34, it should be appreciated that, in some embodiments not depicted, the gasket 35 may be disposed on the liner 18. Accordingly, in these embodiments, when the lid 30 is moved from the open position to the closed position, the lid 30 may compress the gasket 35 formed on the liner 18 such that the seal 40 is formed between the lid 30 and the liner 18. Furthermore, in other embodiments not depicted, the gasket 35 may be formed on an upper surface of the outer body member 14, such that, when the lid 30 is moved from the open position to the closed position, the lid 30 may compress the gasket 35 formed on the outer body member 14 such that the seal 40 is formed between the lid 30 and the outer body member 14.

Referring now to FIGS. 1-4B, the insulating container 10 may further include a latching assembly 50, which may be configured to releasably secure the lid 30 to the outer body member 14 and/or liner 18, as has been described herein. In these embodiments, the latching assembly 50 may include an upper latch member 52, a lower latch member 54, and a pin member 58 that couples the upper latch member 52 to the lower latch member 54.

As depicted in FIGS. 1-4B, the upper latch member 52 may be fixedly coupled to the lid 30 of the insulating container 10. For example, in these embodiments, the upper latch member 52 may be fixedly coupled to the lid 30 via a mechanical fastener (e.g., screws, bolts, riveting, etc.), welding, and/or adhesive bonding. Furthermore, in some embodiments, the upper latch member 52 may be integrally formed (e.g., via molding, etc.) with the lid 30 such that the upper latch member 52 and the lid 30 are a single, monolithic structure. Accordingly, it should be appreciated that, because the upper latch member 52 is fixedly coupled to the lid 30, rotation and/or movement of the upper latch member 52 may result in similar rotation and/or motion of the lid 30, as will be described in additional detail herein with reference to FIGS. 5A-5C.

Referring still to FIGS. 1-4, the upper latch member 52 and the lower latch member 54 may each be pivotally connected to the pin member 58, such that the upper latch member 52 and the lower latch member 54 are independently pivotable relative the pin member 58. For example, in these embodiments, the upper latch member 52 may pivot relative the pin member 58 while the lower latch member 54 remains stagnant, and the lower latch member 54 may similarly pivot relative the pin member 58 while the upper latch member 52 remains stagnant.

Figure 4B:
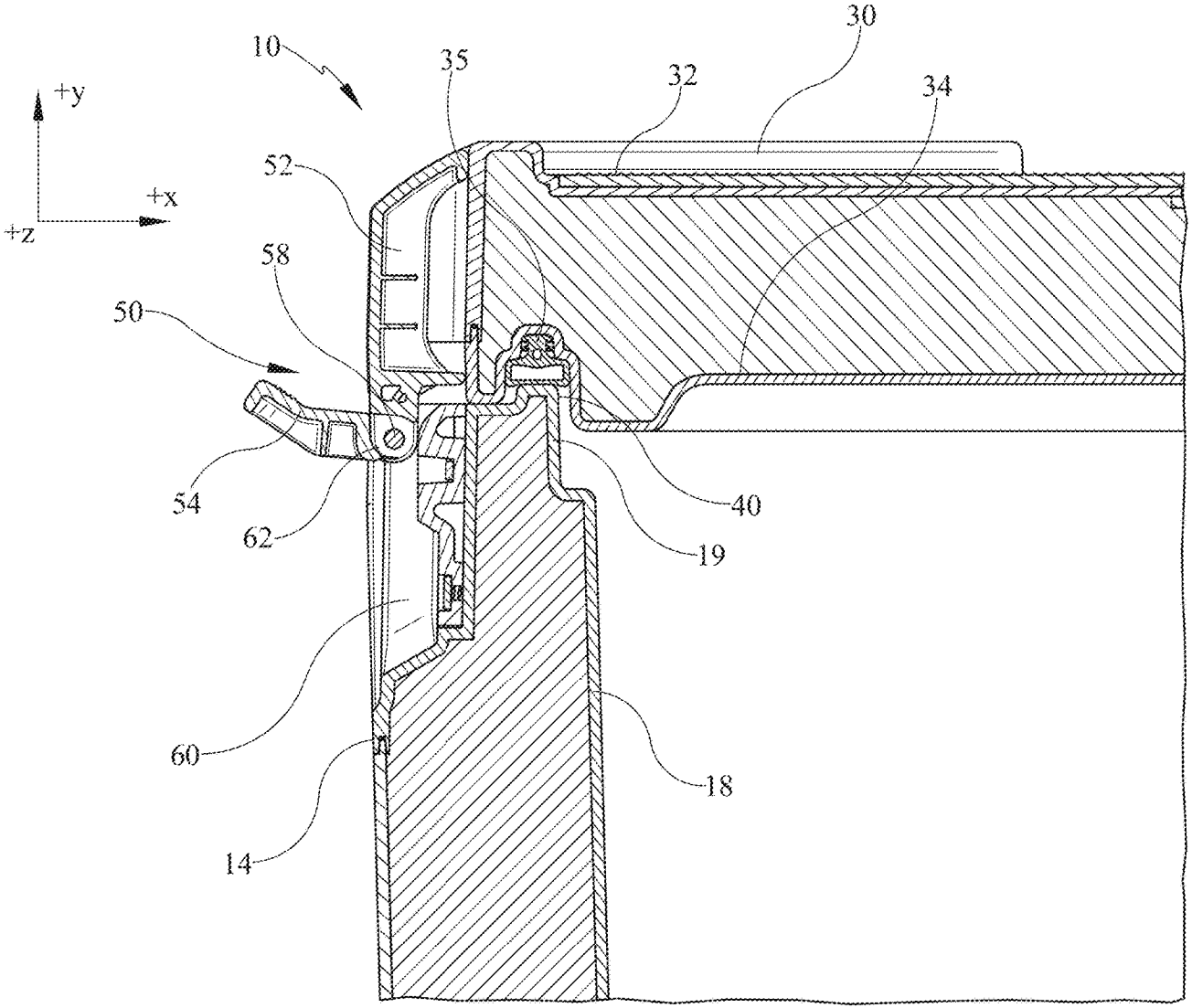
FIG. 4B depicts the cross-sectional view of FIG. 4A with the latching assembly in the release position, according to one or more embodiments shown and described herein.
Figure 5B:
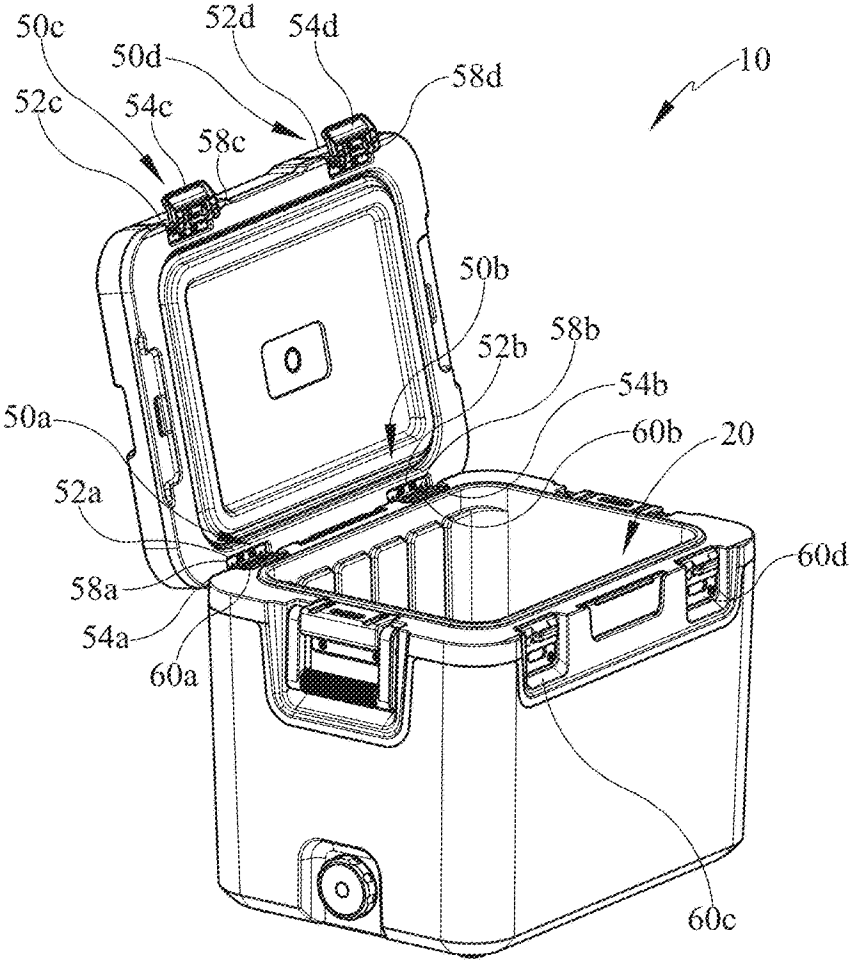
FIG. 5B depicts the insulating container of FIG. 1 in an open position with the lid of the insulating container pivoted in a second direction, according to one or more embodiments shown and described herein.
Figure 5A:
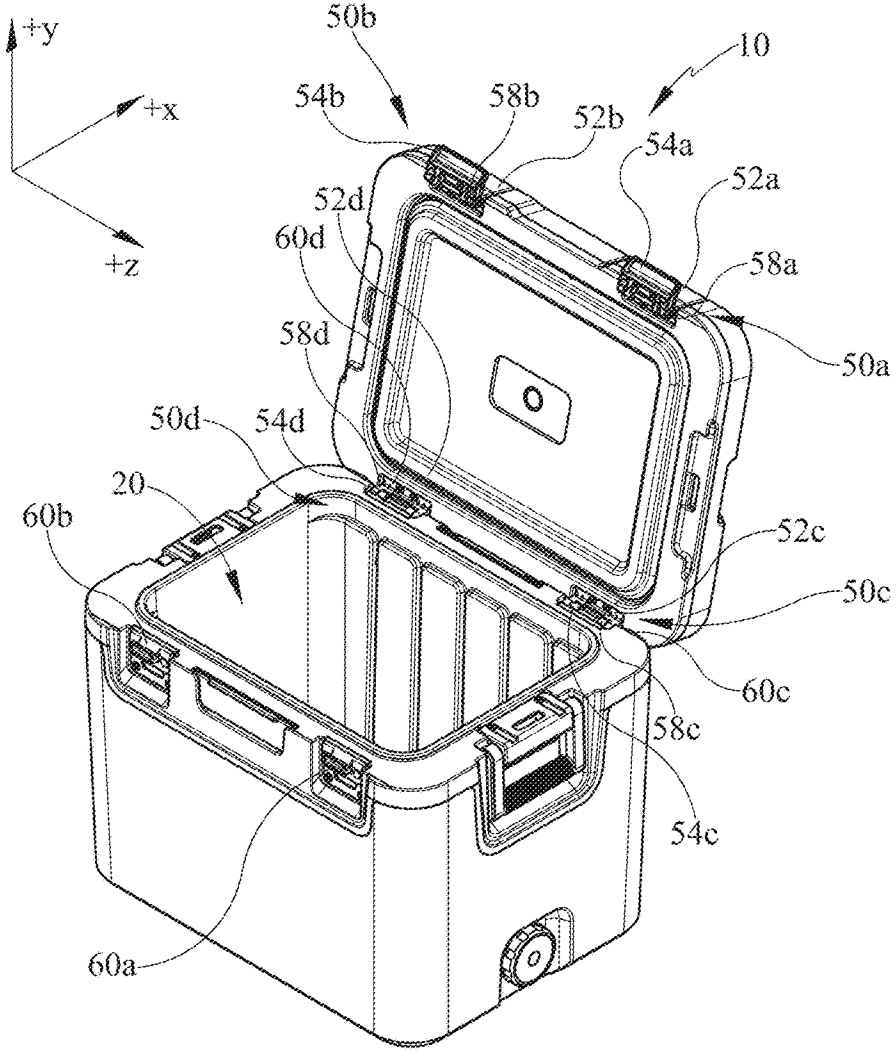
FIG. 5A depicts the insulating container of FIG. 1 in an open position with a lid of the insulating container pivoted in a first direction, according to one or more embodiments shown and described herein.

In the embodiments described herein, the lower latch member 54 may be pivotable about the pin member 58 between a pivoting position and a release position (FIG. 4B, 5A, 5B). For example, in the pivoting position, the lower latch member 54 may secure at least a portion of the lid 30 to the outer body member 14 and/or liner 18 while a separate portion of the lid 30 is free to pivot between the open position and the closed position. In the release position, the lower latch member 54 may be fully disengaged from the outer body member 14, such that the lid 30 may be removed from the outer body member 14 and/or the liner 18. Operation of the latching assembly 50 will be described in additional detail herein with reference to FIGS. 5A-5C.

As further depicted in FIGS. 1-4 the upper latch member 52 and the lower latch member 54 may each be non-planar with the lid 30 and outer body member 14, respectively. For example, as most clearly depicted in FIG. 3, the upper latch member 52 may protrude from the lid 30 in at least one direction (e.g., the +/−x-direction as depicted in the coordinate axes of FIGS. 1-4), such that the upper latch member 52 is non-planar with the lid 30. In these embodiments, the non-planar alignment of the upper latch member 52 and the lid 30 may provide enhanced grip and/or leverage (e.g., when moving the lid 30 between the open position and the closed position) and may allow for a more even distribution of mechanical stress across the upper latch member 52 when the lid 30 is moved between the closed position and the open position and/or the insulating container 10 is moved by grasping the upper latch member 52. In some embodiments, a soft grip material may be attached or molded onto the grip area of the upper latch member 52 to further enhance the grip.

Similarly, it should be appreciated that, in the embodiments described herein, the upper latch member 52 and the lower latch member 54 may include planar and non-planar portions. For example, the lower latch member 54 may be non-planar with the outer body member 14 of the insulating container 10. For example, in the embodiments depicted in FIGS. 1-3, the lower latch member 54 may include a chamfer 56, or other similarly sloped surface, that protrudes in at least one direction (e.g., in the +/−x-direction as depicted in the coordinate axes of FIGS. 1-4) relative to the outer body member 14. In these embodiments, the non-planar alignment of the lower latch member 54 and the outer body member 14 may improve leverage on the lower latch member 54, which may allow for easier pivoting of the lower latch member 54 between the pivoting position and the release position.

Referring still to FIGS. 1-4, the insulating container 10 may further include a knuckle 60 that is configured to receive the pin member 58 of the latch assembly 50. In these embodiments, the knuckle 60 may be fixedly attached to the insulating container 10, such that it may be possible to secure the lid 30 to the outer body member 14 and/or the liner 18 of the insulating container 10 by securing the pin member 58 of the latch assembly 50 to the knuckle 60. As most clearly depicted in FIG. 3, the knuckle 60 may extend between the outer body member 14 and the liner 18 (e.g., through the void 22), and may be fixedly attached to the outer body member 14 via mechanical coupling, welding and/or adhesive, or any other similarly fixed coupling.

It should be appreciated as shown that the liner 18 may extend to the exterior of the insulated container 10. For example, the liner 18 may extent outwardly from the seal 40 and gasket 35 interface such that the liner 18 defines a portion of the exterior and engage the outer body member 14. It should be further appreciated that, in embodiments in which the upper surface of the outer body member 14 is surrounded by and/or covered by the liner 18, the knuckle 60 may be fixedly attached to at least a portion of the liner 18 that surrounds and/or covers the outer body member 14. In these embodiments, the knuckle 60 may be fixedly attached to the liner 18 via mechanical coupling, welding and/or adhesive, or any other similar fixed coupling to secure the knuckle 60 to the insulating container 10.

In these embodiments, the knuckle 60 may further include a seat 62, which may be configured to receive the pin member 58 of the latching assembly 50. For example, in the embodiments described herein, the pin member 58 may form a snap-fit, or any other similar interference fit or slight clearance fit, with the seat 62 of the knuckle 60, such that the pin member 58 may be releasably secured to the seat 62 of the knuckle 60.

Referring still to FIGS. 1-4B, the pin member 58 may be engaged and/or disengaged from the seat 62 of the knuckle 60 by pivoting the lower latch member 54 between the pivoting position (FIG. 4A) and the release position (FIG. 4B). For example, when the lower latch member 54 is in the pivoting position (FIG. 4), the pin member 58 may be secured within the seat 62 of the knuckle 60, such that the latching assembly 50 secures the lid 30 to the outer body member 14 and/or the liner 18. However, when the lower latch member 54 is moved to the release position (FIG. 4B), rotation of the lower latch member 54 from the pivoting position to the release position clears an arm of the lower latch member 54 from beneath the seat 62 and knuckle 60, so that the lid 30 may be lifted. The release position also allows the pin member 58 to become decoupled from the seat 62 of the knuckle 60. Accordingly, when the lower latch member 54 is translated to the release position, the latching assembly 50 may be decoupled from the outer body member 14 and/or liner 18, such that the lid 30 may be fully removed from the outer body member 14 and/or liner 18. Various operations of the latching assembly will be described in additional detail herein with reference to FIGS. 5A-5C.

Referring still to FIGS. 1-4B, it should be appreciated that, in the embodiments described herein, the insulating container may include a plurality of latching assemblies 50 used to pivotally and/or releasably couple the lid 30 to the outer body member 14 and/or the liner 18. For example, in the embodiments depicted in FIGS. 1-4B, the insulating container 10 may include a first latching assembly 50*a*, a second latching assembly 50*b*, a third latching assembly 50*c*, and a fourth latching assembly 50*d*. In these embodiments, each of the plurality of latching assemblies may each include an upper latch member 52*a*-52*d* fixedly coupled to the lid 30, a lower latch member 54*a*-54*d* pivotable between a pivoting position and a release position, and a pin member 58*a*-58*d* that couples the upper latch member 52*a*-52*d* to the lower latch member 54*a*-54*d* and to each of the plurality of latching assemblies 50 respective knuckle 60*a*-60*d*. In these embodiments, there are two latching assemblies per side. However, in other embodiments, such as FIGS. 6A, 6B, one or more latching assemblies per side may be used.

As further depicted in FIGS. 1-4B, the plurality of latching assemblies 50 may be disposed on various portions of the insulating container 10. For example, the first latching assembly 50*a* and the second latching assembly 50*b* may be disposed on the first wall 12*a* while the third latching assembly 50*c* and the fourth latching assembly 50*d* may be disposed on the second wall 12*b* opposite the first wall 12*a*. Although the insulating container 10 depicted in FIGS. 1-4 is shown as having four latching assemblies, it should be appreciated that the insulating container 10 may include any number of latching assemblies without departing from the scope of the present disclosure. Furthermore, the latching assemblies 50 may be disposed on and/or about any surface of the outer body member 14, liner 18, and/or lid 30, as will be described in additional detail herein with reference to FIGS. 6A and 6B.

Figure 5C:
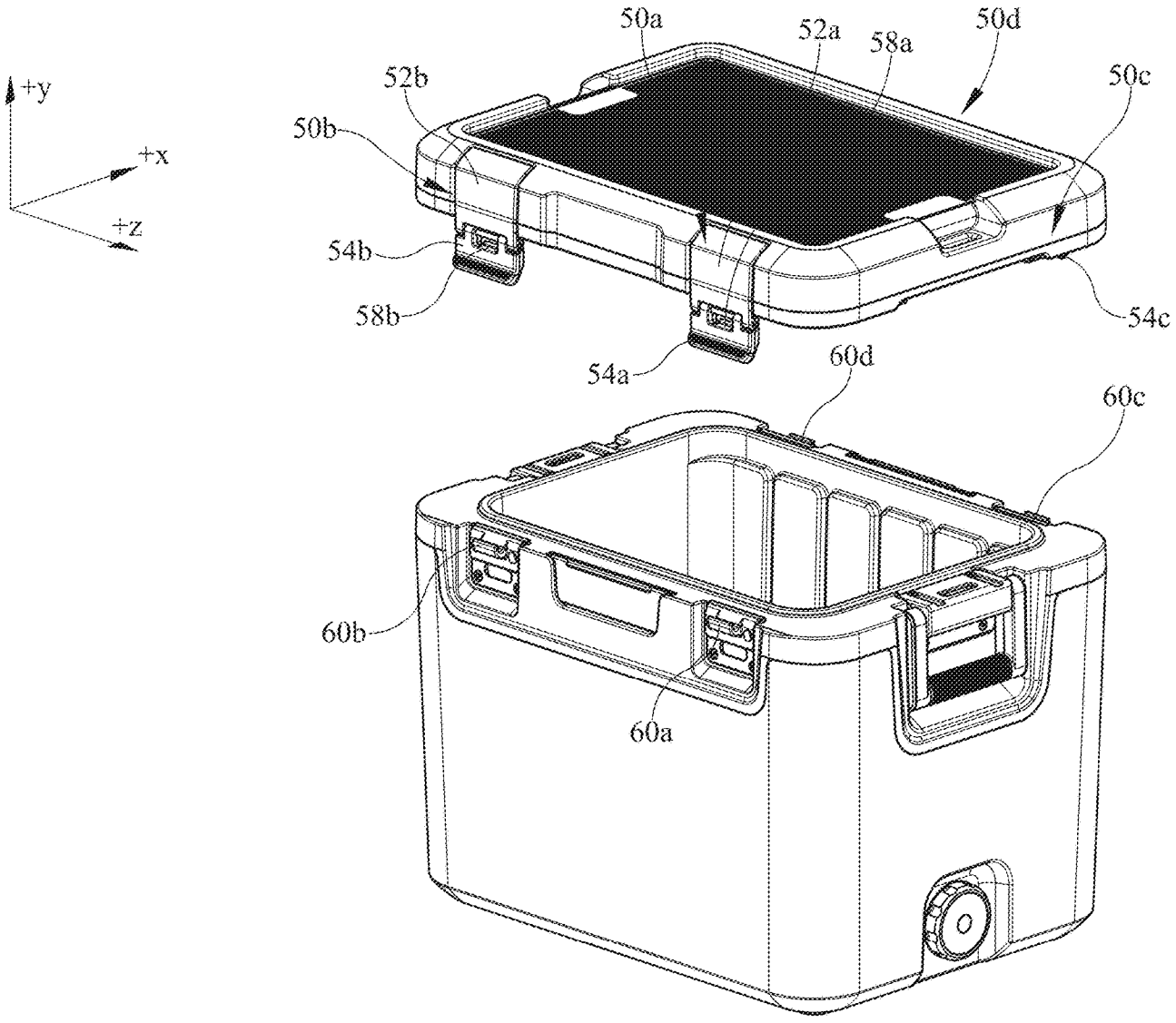
FIG. 5C depicts the insulating container of FIG. 1 with the lid of the insulating container in a release position, according to one or more embodiments shown and described herein.

Turning now to FIGS. 5A-5C, the plurality of latching assemblies 50 may be manipulated in order to allow the lid 30 to move from the closed position to the open position in a first direction (FIG. 5A), a second direction opposite the first direction (FIG. 5B), or be fully removed from the outer body member 14 and/or liner 18 (FIG. 5C).

For example, as depicted in FIG. 5A, the lid 30 may be configured to move from the closed position to the open position by pivoting the lid 30 in a first direction (e.g., clockwise direction), such that a user may access the contents of the internal cavity 20 of the insulating container 10. In these embodiments, the lower latch member 54*a* of the first latching assembly 50*a* and the lower latch member 54*b* of the second latching assembly 50*b* may be moved to the release position, such that the pin member 58*a* of the first latching assembly 50*a* and the pin member 58*b* of the second latching assembly 50*b* may be disengaged from their respective knuckles 60*a*, 60*b*.

While the lower latch members 54*a*, 54*b* of the first and second latching assemblies 50*a*, 50*b* may be moved to the release position, the lower latch member 54*c*, 54*d* of the third and fourth latching assemblies 50*c*, 50*d* may be secured in the pivoting position. Accordingly, as the lid 30 is moved in the first direction, the upper latch members 52*c*, 52*d* of the third and fourth latching assemblies 50*c*, 50*d* may pivot about their respective pin members 58*c*, 58*d*, which may in turn allow for the lid 30 to translate from the closed position to the open position.

Referring now to FIG. 5B, the lid 30 may also be moved from the closed position to the open position by pivoting the lid 30 in the second direction (e.g., counterclockwise) opposite the first direction. In these embodiments, adjusting the plurality of latching assemblies 50 may allow for the lid 30 to pivot relative the first and second latching assemblies 50*a*, 50*b* (e.g., in the second direction), as will be described in additional detail herein.

For example, as shown in FIG. 5B, the lower latch member 54*a* of the first latching assembly 50*a* and the lower latch member 54*b* of the second latching assembly 50*b* may be moved to the pivoting position, such that the pin member 58*a* of the first latching assembly 50*a* and the pin member 58*b* of the second latching assembly 50*b* are secured within their respective knuckles 60*a*, 60*b*.

While the lower latch members 54*a*, 54*b* of the first and second latching assemblies 50*a*, 50*b* are moved to the pivoting position, the lower latch member 54*c*, 54*d* of the third and fourth latching assemblies 50*c*, 50*d* may be moved to the release position, such that the pin member 58*c* of the third latching assembly 50*c* and the pin member 58*d* of the fourth latching assembly 50*d* are disengaged from their respective knuckles 60*c*, 60*d*. Accordingly, as the lid 30 is moved in the second direction, the upper latch members 52*a*, 52*b* of the first and second latching assemblies 50*a*, 50*b* may pivot about their respective pin members 58*a*, 58*b*, which may in turn allow for the lid 30 to translate from the closed position to the open position.

Referring now to FIG. 5C, and as described in detail herein, the plurality of latching assemblies 50 may further allow for the lid 30 to be fully removed from the outer body member 14 and/or liner 18 of the insulating container 10. In these embodiments, the lower latch member 54*a*-54*d* of each of the plurality of latching assemblies 50*a*-50*d* may be moved from the pivoting position to the release position, such that the pin member 58*a*-58*d* of each of the plurality of latching assemblies 50*a*-50*d* is disengaged from its respective knuckle 60*a*-60*d*. With the pin member 58*a*-58*d* of each of the plurality of latching assemblies 50*a*-50*d* decoupled from their respective knuckles 60*a*-60*d*, the lid 30 may be removed from the outer body member 14 and/or liner 18 of the insulating container 10, as has been described in detail herein.

Figure 6B:
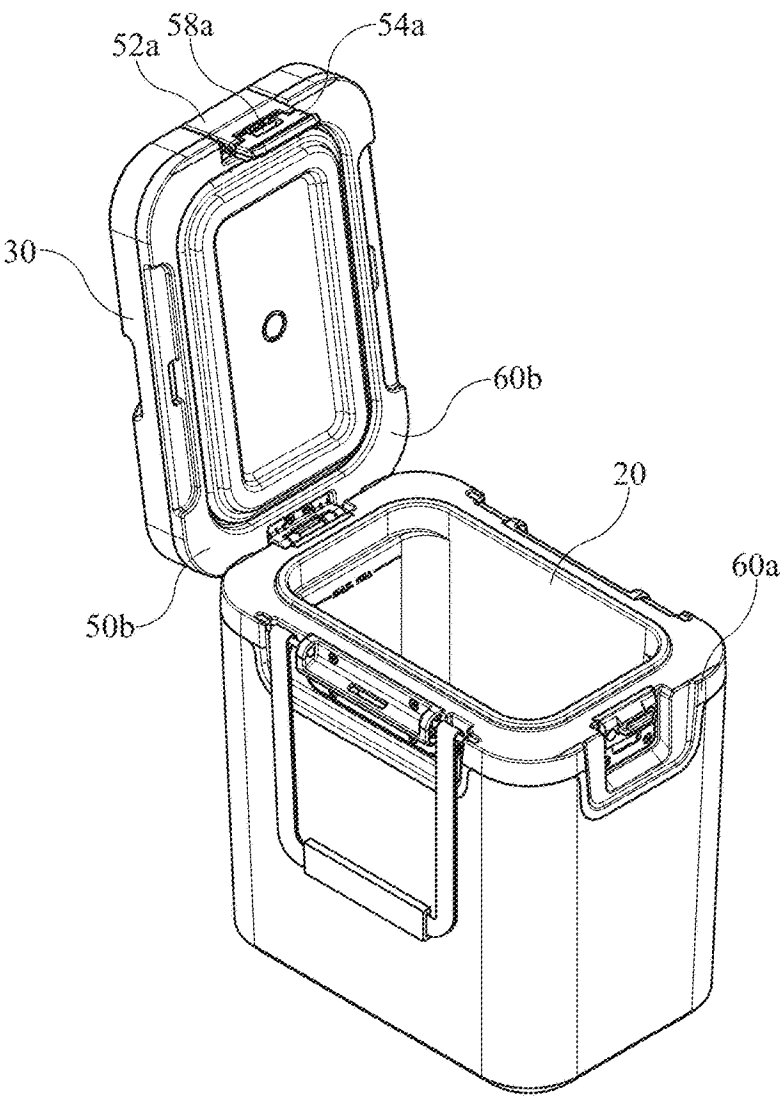
FIG. 6B depicts the insulating container of FIG. 5A with the lid in an open position, according to one or more embodiments shown and described herein.
Figure 6A:
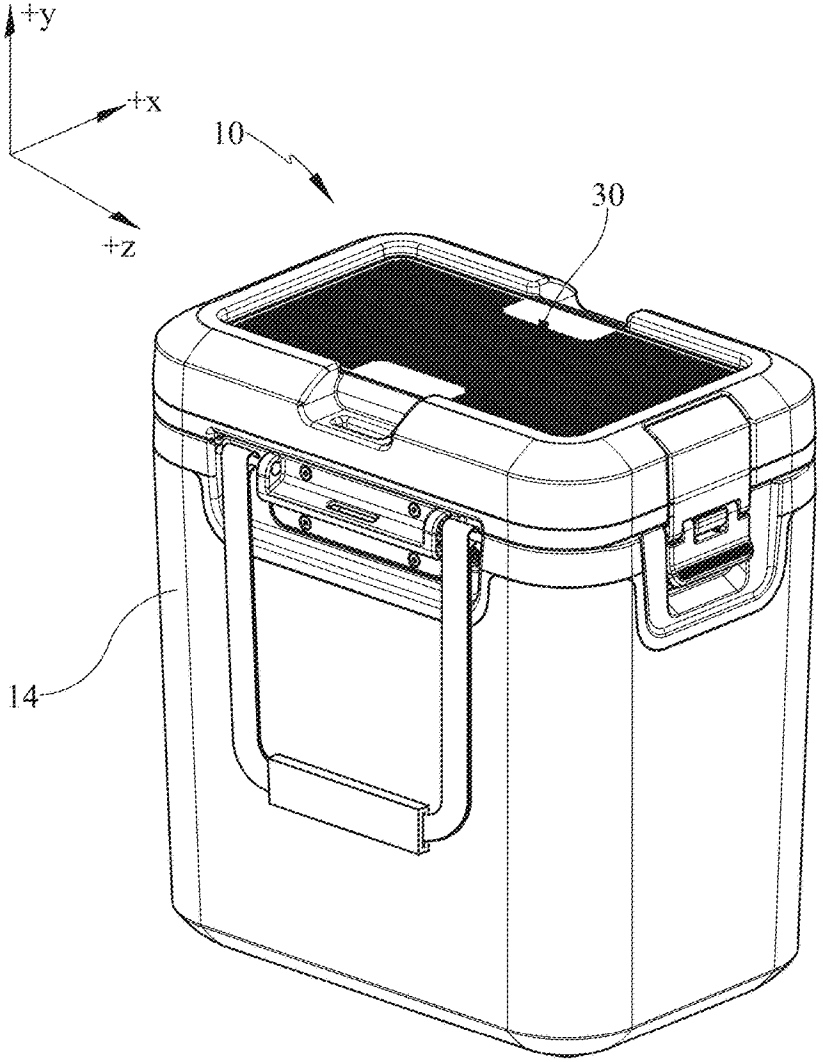
FIG. 6A depicts another embodiment of the insulating container of FIG. 1 in with a lid in a closed position, according to one or more embodiments shown and described herein.

Turning now to FIGS. 6A and 6B, another embodiment of an insulating container 10 is depicted. In these embodiments, the plurality of latching assemblies 50 may include a first latching assembly 50*a* and a second latching assembly 50*b*, with the first and second latching assemblies being disposed on the pair of sidewalls 12*c*, 12*d* (e.g., as opposed to the first wall 12*a* and second wall 12*b* as depicted in FIGS. 1-5C).

In these embodiments, the lid 30 of the insulating container 10 may be similarly releasably and/or pivotally attached to the outer body member 14 and/or liner 18 via the plurality of latching assemblies 50. For example, as described herein with reference to FIGS. 5A-5C, the lid 30 may be moved from the closed position to the open position by pivoting the lid 30 in a first direction or a second direction opposite the first direction.

As depicted in FIG. 6B, by placing the lower latch member 54*a* of the first latching assembly 50*a* in the release position and placing the lower latch member 54*b* of the second latching assembly 50*b* in the pivoting position, the lid 30 may be moved from the closed position to the open position by pivoting the lid 30 in the first direction, such that the first latching assembly 50*a* becomes disengaged from the outer body member 14 and/or liner 18 while the upper latch member 52*b* of the second latching assembly 50*b* pivots about its pin member 58*b* to move the lid 30. Similarly, by reversing the configuration of the first latching assembly 50*a* and the second latching assembly 50*b* (e.g., moving the lower latch member 54*a* of the first latching assembly 50*a* to the pivoting position and moving the lower latch member 54*b* of the second latching assembly to the release position), it may be possible to move the lid 30 from the closed position to the open position by pivoting the lid 30 in the second direction opposite the first direction, as has been described in detail herein. Furthermore, although not depicted, it should be appreciated that the lid 30 of the insulating container 10 depicted in FIGS. 6A and 6B may be fully detached from the outer body member 14 and/or liner 18 by moving the lower latch member 54*a*, 54*b* of each of the first latching assembly 50*a* and the second latching assembly 50*b* to the release position, such that neither of the first latching assembly 50*a* nor the second latching assembly 50*b* is coupled to the outer body member 14 and/or liner 18.

It should be appreciated that the insulating containers 10 depicted in FIGS. 1-6B are presented for illustrative purposes only, and the configurations contemplated herein are not intended to limit the scope of the present disclosure. For example, the insulating container 10 may include any number of latching assemblies 50, with the latching assemblies 50 being disposed on any surface of the outer body member 14, the liner 18 and/or the lid 30. In these embodiments, an insulating container 10 may include a lid 30 that is pivotable in a first direction and a second direction opposite the first direction to move the lid 30 from the closed position to the open position by utilizing at least two latching assemblies positioned opposite one another and placing the lower latch member of at least one of the latching assemblies in the pivoting position and placing the lower latch member of the at least one other latching assembly in the release position. Furthermore, in the embodiments described herein, the lid 30 of an insulating container 10 having any number of latching assemblies may be releasable from the outer body member 14 and/or liner 18 by placing the lower latching member of each of the latching assemblies in the release position, as has been described in detail herein.

Turning now to FIGS. 7A-14, additional features of the insulating container 10 depicted in FIGS. 1-6B will be described in detail herein. It should be appreciated that, in the embodiments described herein, the insulating container 10 may include any number and/or combination of the features illustrated in FIGS. 7A-14 without departing from the scope of the present disclosure.

Figure 7A:
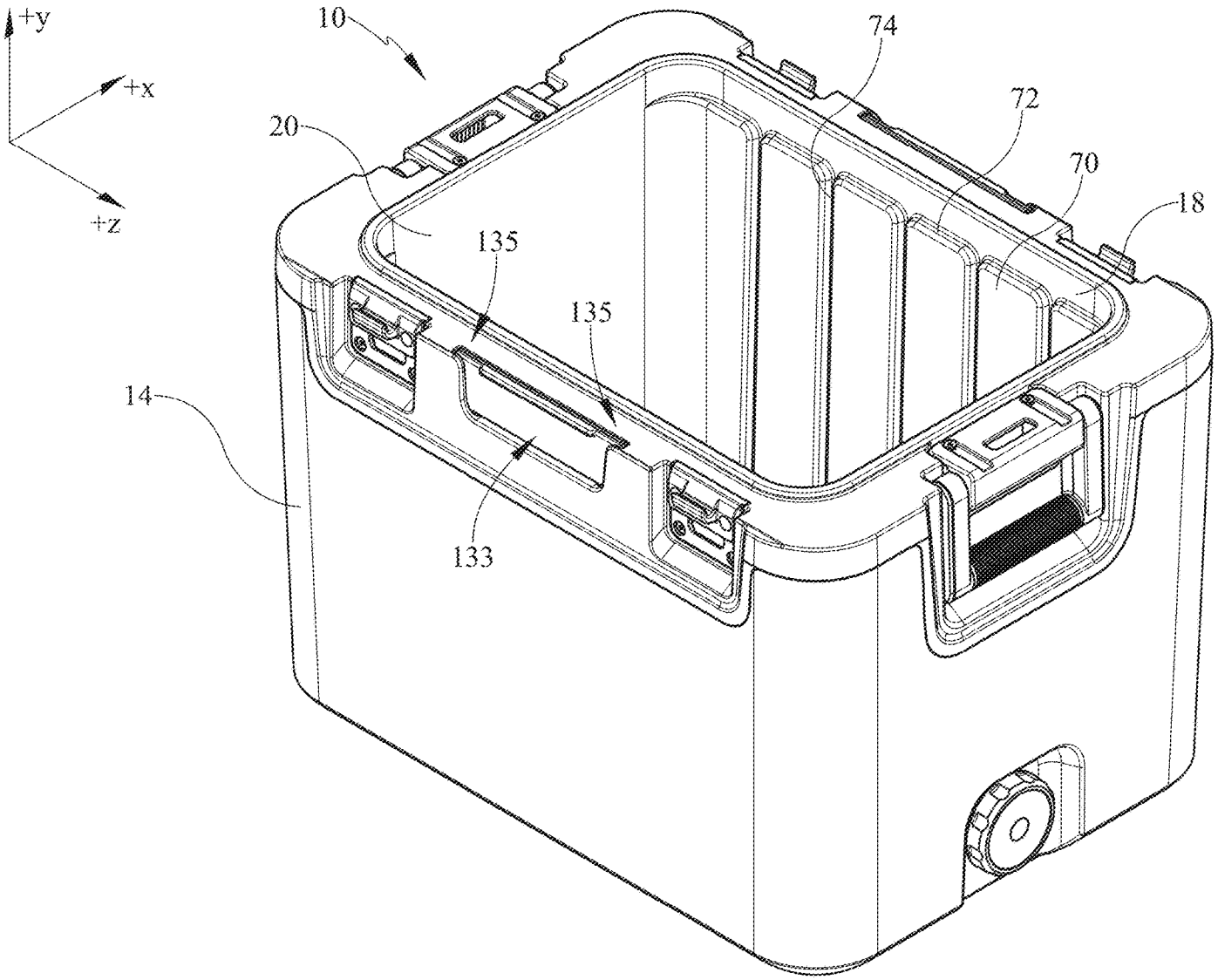
FIG. 7A depicts a perspective view of the insulating container of FIG. 1 with the lid of the insulating container removed, according to one or more embodiments shown and described herein.
Figure 7B:
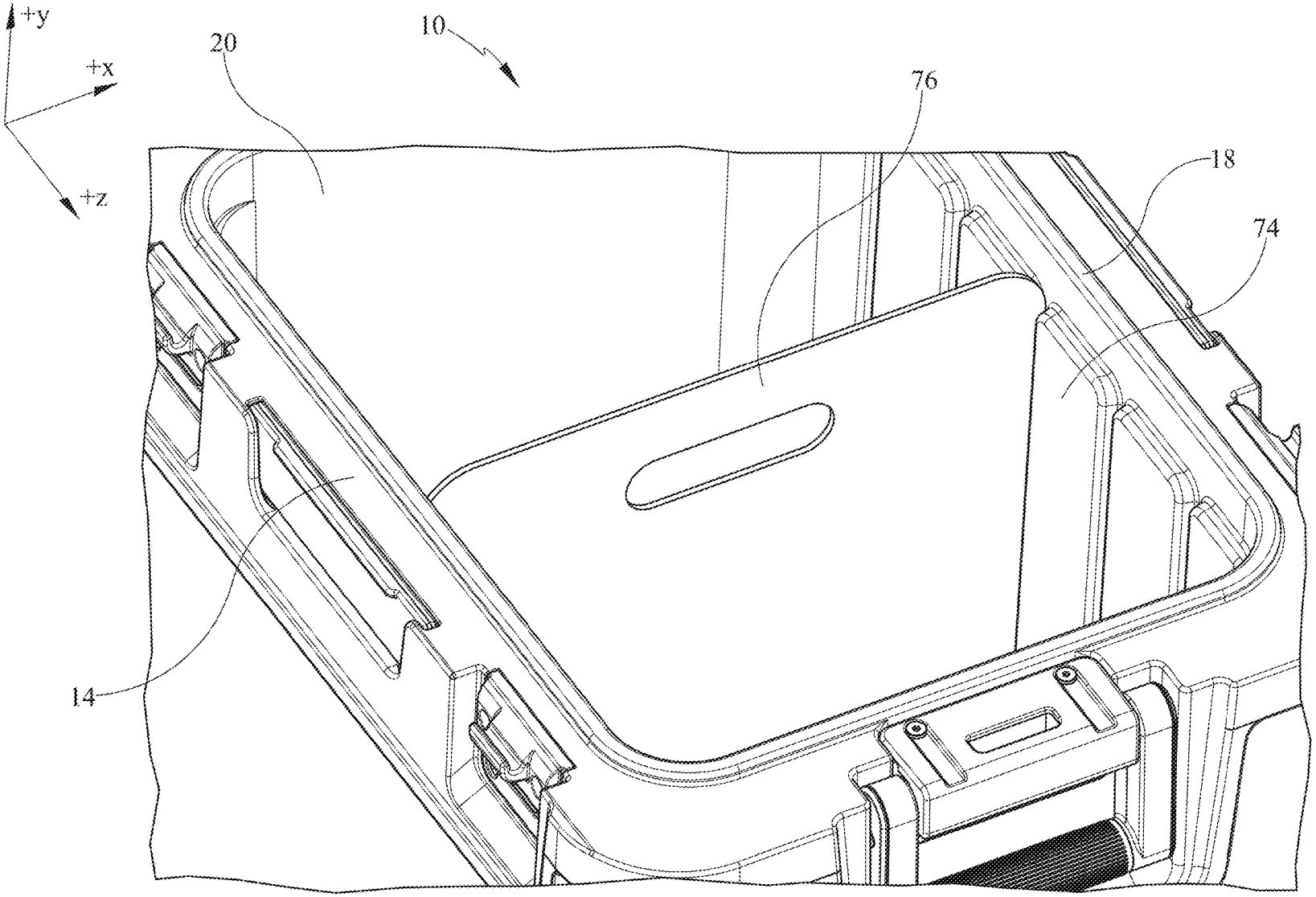
FIG. 7B depicts a partition of the insulating container of FIG. 1 disposed within an internal cavity of the insulating container, according to one or more embodiments shown and described herein.

Referring now to FIGS. 7A and 7B, the insulating container 10 is depicted with the lid 30 removed from the outer body member 14 and/or liner 18, such that the internal cavity 20 is exposed. In these embodiments, the internal cavity 20 may further include a plurality of protrusions 70 extending inwardly (e.g., in the +/−x-direction as depicted in the coordinate axis of FIG. 7A) from the liner 18, such that each of the plurality of protrusions 70 includes an upper surface 72 having a protrusion thickness.

As further depicted in FIGS. 7A and 7B, a plurality of grooves 74 may be defined between the plurality of protrusions 70, such that at least one groove is defined between each pair of the plurality of protrusions 70. In these embodiments, the plurality of grooves 74 may be configured to receive a plurality of partitions 76, as depicted in FIG. 7B, which may be used to divide the internal cavity 20 of the insulating container 10 into a plurality of sections. As illustrated in FIGS. 7A and 7B, the plurality of partitions 76 may be positioned within different grooves of the plurality of grooves 74 to adjust the size of each of the plurality of sections within the internal cavity 20 of the insulating container 10.

In these embodiments, the plurality of partitions 76 may be sized (e.g., having a length and width) such that each of the plurality of partitions 76 may be slid into the plurality of grooves 74 by a user to divide the internal cavity 20. As should be appreciated, by the plurality of partitions 76 may allow a user to separate materials (e.g., food products, beverages, etc.) within the internal cavity 20 to more efficiently organize and/or utilize the space within the internal cavity 20. Furthermore, the plurality of partitions 76 may be used to separate items different types of items (e.g., raw and cooked items), and/or items that may require different temperature levels.

Furthermore, although the plurality of protrusions 70 and the plurality of grooves 74 are depicted as each having the same width and height, it should be appreciated that, in some embodiments, the plurality of protrusions 70 and the plurality of grooves 74 may have different widths and/or heights. For example, by including a plurality of grooves 74 having various widths within the internal cavity 20, it may be possible to utilize a plurality of partitions 76 having various thicknesses within the internal cavity 20. In the embodiments described herein, the plurality of partitions 76 may be formed of plastic, metal, foam, fabric and/or mesh, or any other similar material capable of dividing the internal cavity 20 of the insulating container 10 into a plurality of sections, as described herein.

Figure 8:
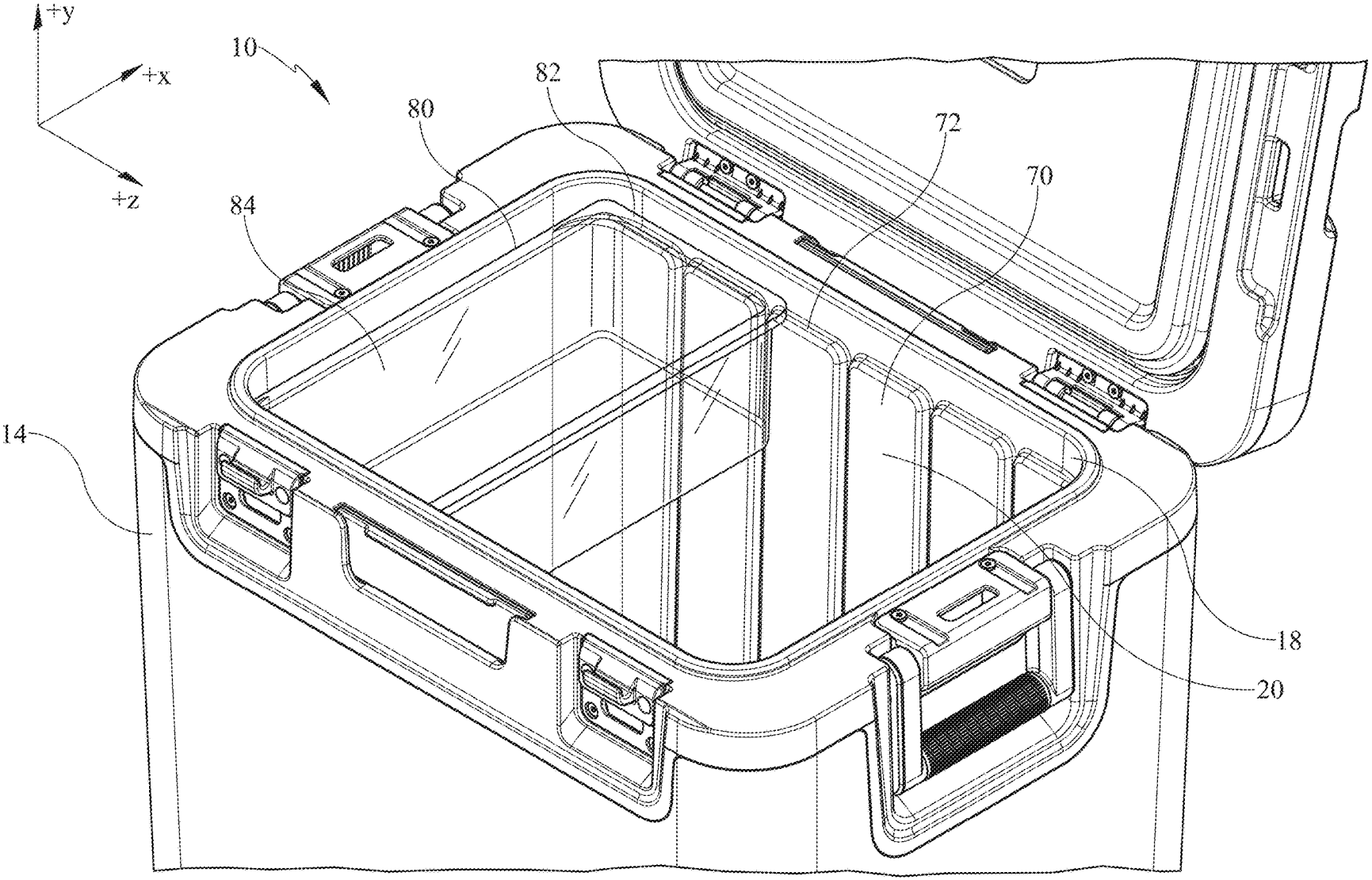
FIG. 8 depicts the insulating container of FIG. 1 including a storage basket, according to one or more embodiments shown and described herein.

Turning now to FIG. 8, the insulating container 10 may further include a storage mechanism 80, such as a basket, which may further aid in organizing and/or dividing the internal cavity 20 of the insulating container 10. The basket 80 may be formed of glass, plastic, wire, or other such structures. In these embodiments, the storage mechanism 80 may include a rim 82 that may be configured to engage the upper surface 72 of each of the plurality of protrusions 70. For example, in the embodiments described herein, the rim 82 may be configured to extend radially outward from and/or overhang a storage body 84 of the storage mechanism 80, such that a perimeter of the rim 82 is larger than a perimeter of the storage body 84.

As depicted in FIG. 8 the storage body 84 may have a length and/or width that is less than a distance between the plurality of protrusions 70 formed within the internal cavity 20 (e.g., on each side of the liner 18), while the rim 82 of the storage mechanism 80 has a length and/or width that is less than a length and/or width of the internal cavity 20 and greater than the distance between the plurality of protrusions 70. Accordingly, the storage mechanism 80 may be inserted into the internal cavity 20 of the insulating container 10 such that the storage body 84 of the storage mechanism 80 extends downwardly into the internal cavity 20 (e.g., between the plurality of protrusions 70) while the rim 82 of the storage mechanism 80 abuts the upper surface 72 of the plurality of protrusions 70 and secures the storage mechanism 80 in a desired position.

Although FIG. 8 depicts the insulating container 10 as including a single storage mechanism 80, it should be appreciated that the insulating container 10 may include any number of storage mechanisms 80 having varying sizes without departing from the scope of the present disclosure.

Figure 9B:
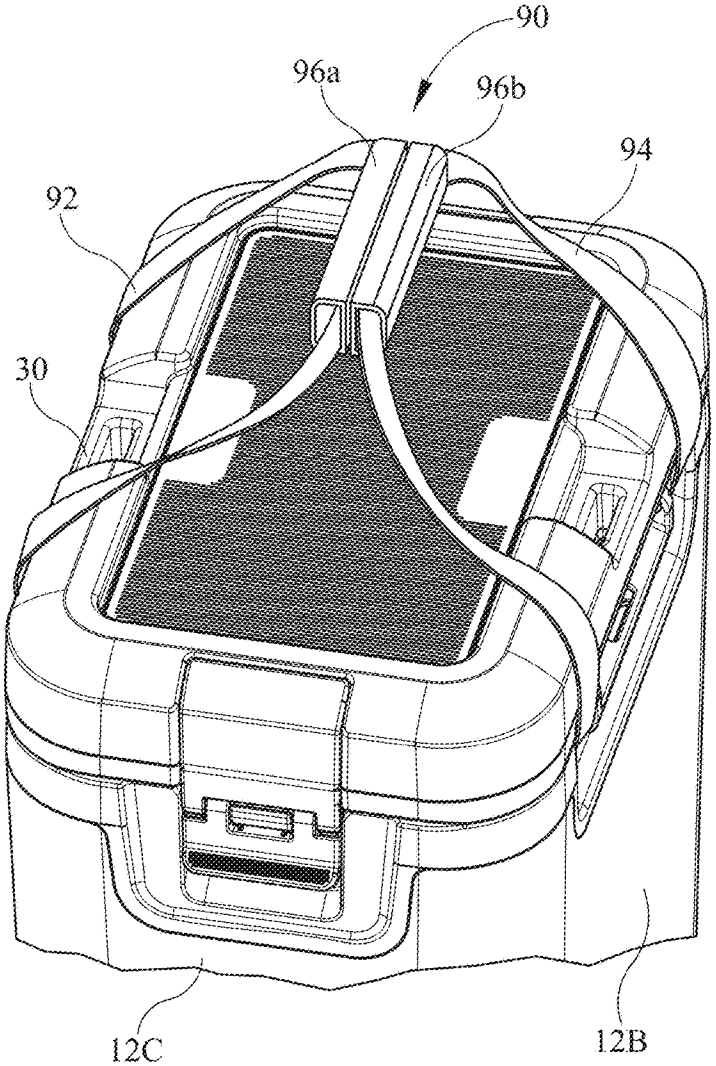
FIG. 9B depicts a first handle component of the insulating container of FIG. 1 coupled to a second handle component, according to one or more embodiments shown and described herein.
Figure 9A:
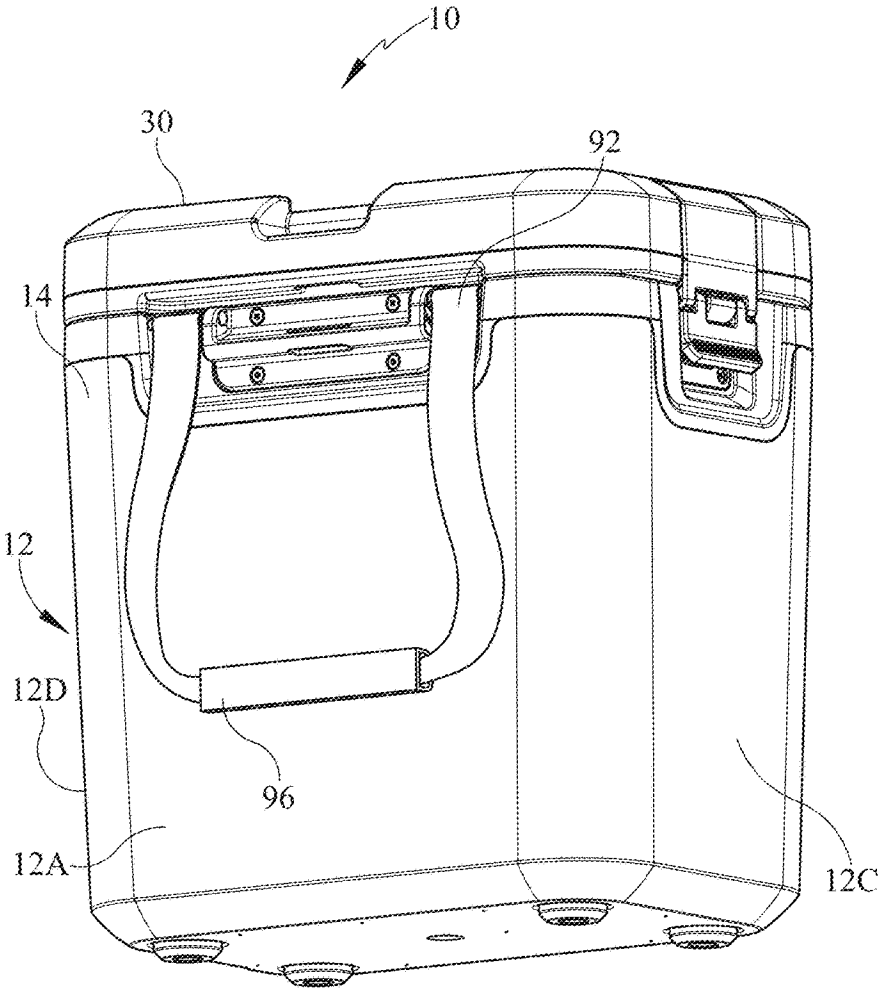
FIG. 9A depicts a first handle component of the insulating container of FIG. 1, according to one or more embodiments shown and described herein.

Referring now to FIGS. 9A and 9B, in some embodiments, the insulating container 10 may further include a handle 90 that may be used to transport the insulating container 10. In these embodiments, the handle 90 may include a first handle component 92 and a second handle component 94, with the first handle component 92 being releasably couplable to the second handle component 94 to form the handle 90. For example, in the embodiments described herein, the first handle component 92 and the second handle component 94 may each include a strap, which may be formed of a material that is capable of supporting a weight of the insulating container 10 and any additional materials stored within the internal cavity 20. In these embodiments, the first handle component 92 and the second handle component 94 may be formed of silicone, rubber, thermoplastic elastomers, soft PVC, elastomers, foamed gel, gel materials, fabric, webbing, cloth, or any other similar material.

In the embodiments depicted in FIGS. 9A and 9B, the first handle component 92 may be formed on and/or fixedly attached to the first wall 12*a* of the outer body member 14, while the second handle component 94 may be formed on and/or fixedly attached to the second wall 12*b* (e.g., opposite of the first wall 12*a*). In these embodiments the first handle component 92 and the second handle component 94 may be affixed to the first and second wall 12*a*, 12*b*, respectively, via a mechanical fastener (e.g, screws, bolts, pins, rivets, etc.), integral molding, welding, adhesive bonding, a bracket system (e.g., metal and/or plastic brackets), an interlocking mechanism (e.g., snap-fit mechanism, etc.), or any other similarly fixed coupling. It should be appreciated that, the coupling mechanism 96 used to secure the first handle component 92 and the second handle component 94 to the first wall 12*a* and the second wall 12*b* should have sufficient strength to support a weight of the insulating container 10 and any additional materials that may be stored in the internal cavity 20.

Furthermore, although the insulating container depicted in FIGS. 9A and 9B illustrates the first handle component 92 and the second handle component 94 as being disposed on the first wall 12*a* and the second wall 12*b*, respectively, it should be appreciated that the handle components may be disposed on any pair of opposite walls without departing from the scope of the present disclosure. For example, in some embodiments, the first handle component 92 and the second handle component 94 may be disposed on opposite walls of the pair of sidewalls 12*c*, 12*d*. In these embodiments, the size, shape, and/or strength requirements of the insulating container 10 may determine the positioning of the handle components. Furthermore, in some embodiments, the positioning of the plurality of latching assemblies may further impact the positioning of the handle components.

Referring still to FIGS. 9A and 9B, the first handle component 92 and the second handle component 94 may each include a coupling mechanism 96 (e.g., first coupling mechanism 96*a* disposed on the first handle component 92 and second coupling mechanism 96*b* disposed on the second handle component 94) configured to releasably couple the first handle component 92 to the second handle component 94 to form the handle 90. For example, as depicted in FIGS.

9A and 9B, the coupling mechanism 96 may be a magnet. Accordingly, when the first handle component 92 and the second handle component 94 are placed in physical contact with one another, the magnet disposed in each of the first handle component 92 and the second handle component 94 may act to releasably secure the first handle component 92 to the second handle component 94 to form the handle 90.

Although FIGS. 9A and 9B depict the coupling mechanism 96 as being a magnet, it should be appreciated that the coupling mechanism 96 may include any releasable coupling means without departing from the scope of the present disclosure. For example, the coupling mechanism 96 may further include an adhesive (e.g., Velcro, etc.), a clipping mechanism or pin, a snap-fit joint, interference fit, or any other similar releasable coupling.

Figure 10B:
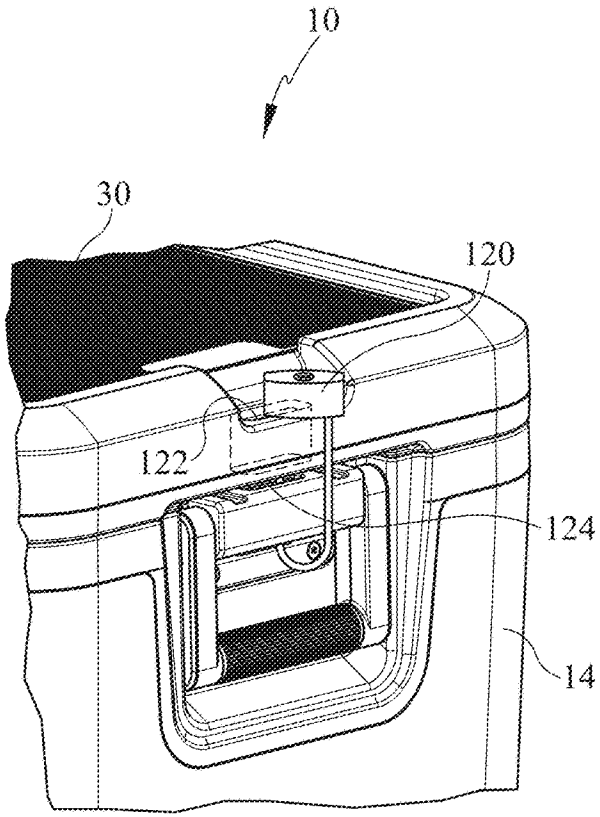
FIG. 10B depicts the insulating container of FIG. 1 including another embodiment of a locking mechanism, according to one or more embodiments shown and described herein.
Figure 10A:
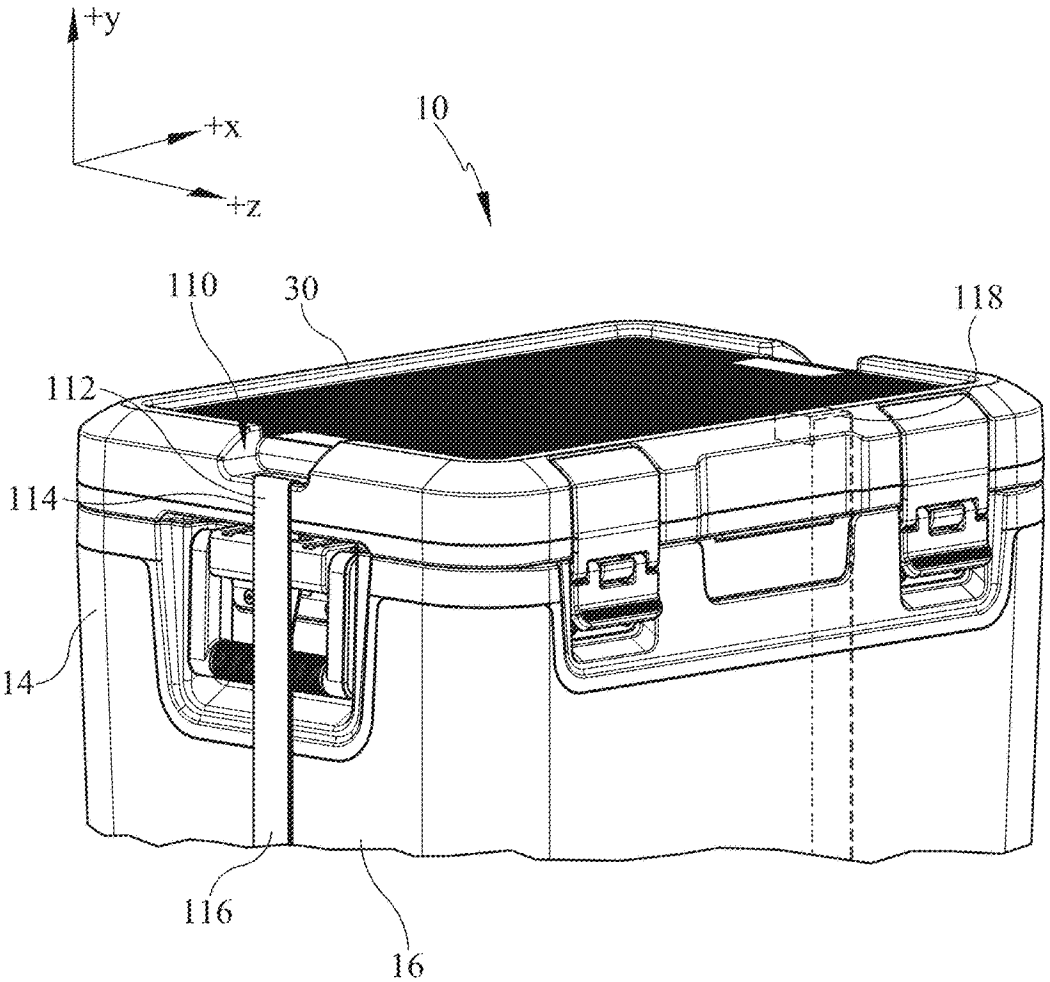
FIG. 10A depicts the insulating container of FIG. 1 including a locking mechanism, according to one or more embodiments shown and described herein.

Turning now to FIGS. 10A and 10B, in some embodiments, the insulating container 10 may further include a locking mechanism 110. In these embodiments, the locking mechanism 110 may be configured to lock the lid 30 of the insulating container 10 to the outer body member 14 and/or liner 18 in order to allow a user to secure materials within insulating container 10.

For example, in some embodiments, such as the embodiment depicted in FIG. 10A, the locking mechanism 110 may include a tether 112 configured to lock the lid 30 to the outer body member 14 and/or liner 18. In these embodiments, the tether 112 may include a first end 114 fixedly attached to the lid shell 32, and a second end 116 that is securable to at least a portion of the insulating container 10. For example, the base member 16 of the insulating container 10 may include a tether receiver 118, such as a hook, notch, groove, seat, or other similar receiver, which may be configured to receive the second end 116 of the tether 112. In these embodiments, the tether 112 may have a variable length, such that, when the second end of the tether 112 is attached to the tether receiver 118, the tether 112 may be tightened in order to effectively lock the lid 30 to the outer body member 14 and/or liner 18.

In other embodiments, the tether receiver 118 may be formed on an opposite side of the lid 30 to which the tether 112 is fixedly attached. In these embodiments, the tether 112 may extend fully around (e.g., underneath) the base member 16 of the outer body member 14 and secured to the tether receiver 118 positioned on the opposite side of the lid 30. With the second end 116 of the tether 112 secured to the tether receiver 118, the length of the tether 112 may be adjusted to tighten the tether 112 and lock the lid 30 to the outer body member 14. It should be appreciated that, in these embodiments, extending the tether 112 between opposite sides of the lid 30 and beneath the base member 16 of the outer body member 14 may prevent the lid 30 from being removed from the outer body member 14.

In the embodiments described herein, it should be further understood that the tether 112 may include a strap or other structure having a first end and a second end and having sufficient size and/or flexibility to extend around an outer perimeter of the insulating container 10. For example, the tether 112 may be formed of fabric, plastic, rubber or other any other similar flexible, bendable material.

Referring now to FIG. 10B, in other embodiments, the locking mechanism 110 may include a lock 120 configured to lock the lid 30 to the outer body member 14. In these embodiments, the lid 30 may include a lid locking aperture 122 while the outer body member 14 may include a body locking aperture 124, with the lid 30 being disposed on the outer body member 14 such that the lid locking aperture 122 is in alignment (e.g., vertical alignment as depicted in FIG. 10B) with the body locking aperture 124. With the lid locking aperture 122 and the body locking aperture 124 aligned, the lock 120 may be passed through the lid locking aperture 122 and the body locking aperture 124 and secured to lock the lid 30 to the outer body member 14 and/or liner 18.

Figure 12:
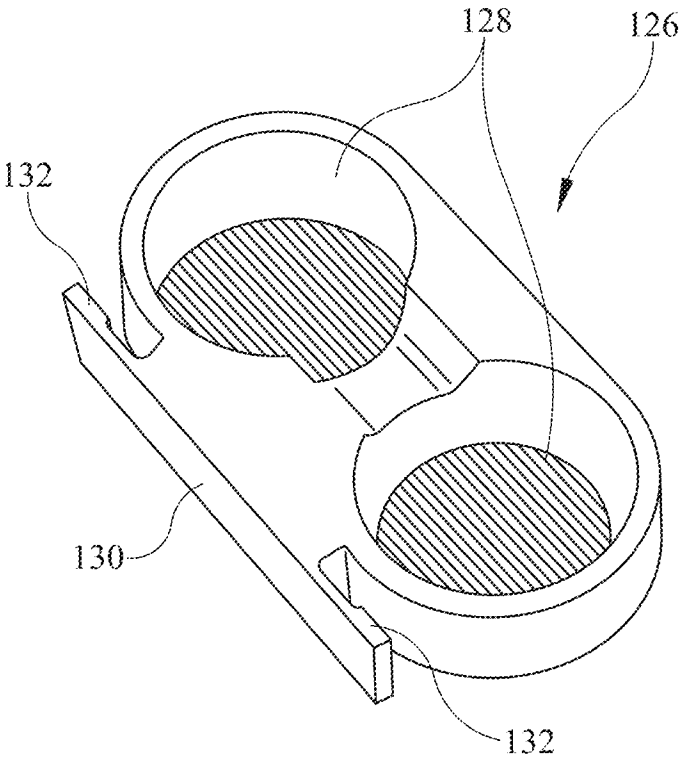
FIG. 12 depicts the holding component of FIG. 11, according to one or more embodiments shown and described herein.
Figure 11:
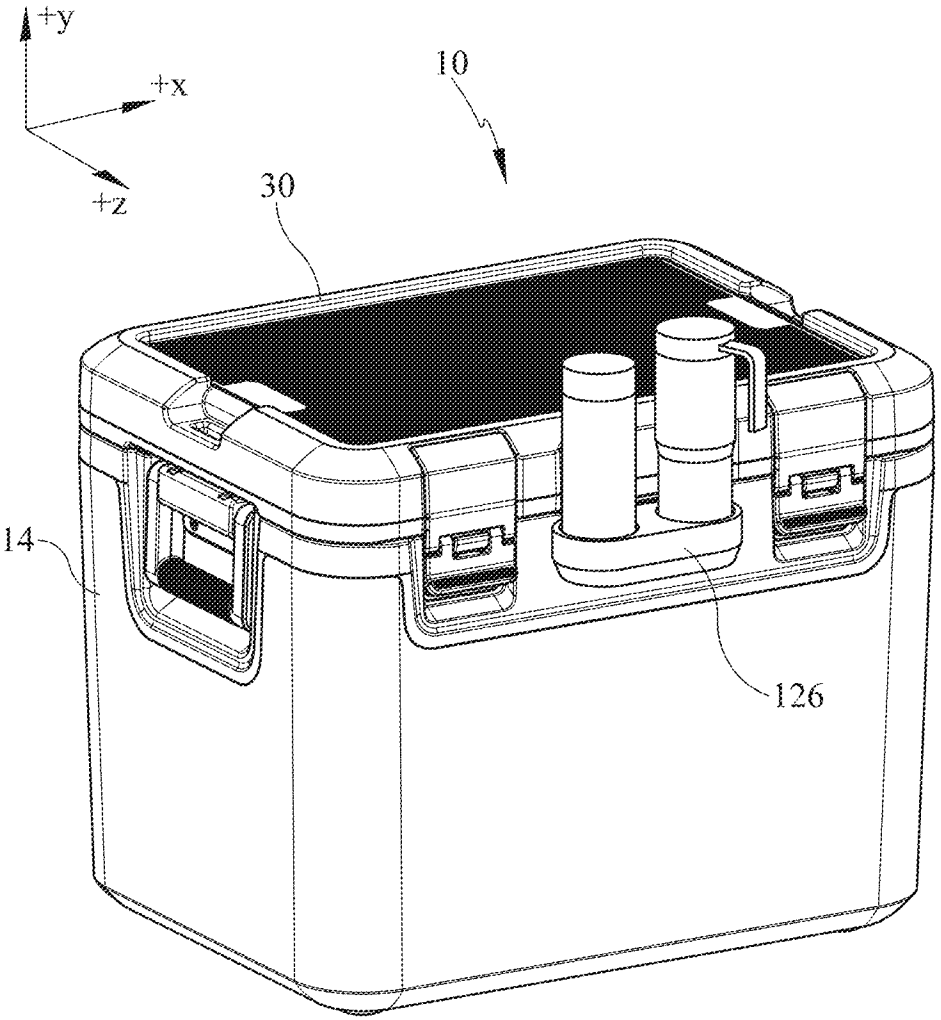
FIG. 11 depicts the insulating container of FIG. 1 with a holding component, according to one or more embodiments shown and described herein.

Turning now to FIGS. 11 and 12, the insulating container 10 may further include a holding component 126, such as a beverage holding component, that may allow a user to secure materials (e.g., beverages, food materials, etc.) externally to the insulating container 10. In these embodiments, the holding component 126 may provide a user with a location to store and/or secure materials without moving the lid 30 from the open position to the closed position, which may negatively impact the ability of the internal cavity 20 to maintain materials disposed within the internal cavity 20 at a desired temperature.

In the embodiments depicted in FIGS. 11 and 12, the holding component 126 may include a plurality of receptacles 128, with each of the plurality of receptacles 128 being sized and/or shaped to hold a particular material. Although FIGS. 11 and 12 depict the holding component 126 as including two receptacles (e.g., a first receptacle and a second receptacle), it should be appreciated that the holding component 126 may include any number of receptacles without departing from the scope of the present disclosure. Furthermore, although the plurality of receptacles 128 depicted in FIGS. 11 and 12 are shown as having a similar size and shape, it should be understood that each of the plurality of receptacles 128 formed within the holding component 126 may have a unique size and/or shape in order to accommodate varying materials.

Referring still to FIGS. 11 and 12, the holding component 126 may further include an arm 130 that extends from the plurality of receptacles 128 and is configured to secure the holding component 126 to the insulating container 10. For example, in the embodiments depicted in FIGS. 11 and 12, the arm 130 may include a plurality of clips 132 that may be flexible and/or deformable to couple with an edge and/or rim of the outer body member 14, the liner 18 and/or the lid 30. Furthermore, in other embodiments not depicted, the arm 130 may include a rail and the outer body member 14, the liner 18 and/or the lid 30 may include a slot, such that the arm 130 may be slidably attached to the insulating container 10. In these embodiments, it should be appreciated that the holding component 126 may be configured to be easily removed and attached to the insulating container 10 as desired by a user. In other embodiments still, when the lid 30 is in the open position, the arm 130 and each of the plurality of clips 132 may be insertable into a slots 135 (FIG. 7) of recess 133 (FIG. 7) formed within the lid 30, the outer body member 14, the liner 18 and/or the internal cavity 20, such that moving the lid 30 from the open position to the closed position secures the arm 130 to the insulating container 10. For example, the slot 135 may be formed at ends of a recess 133 that is in the outer body member 14, the liner 18, and/or the lid 30, access to which may be provided by opening the lid 30.

Figure 13B:
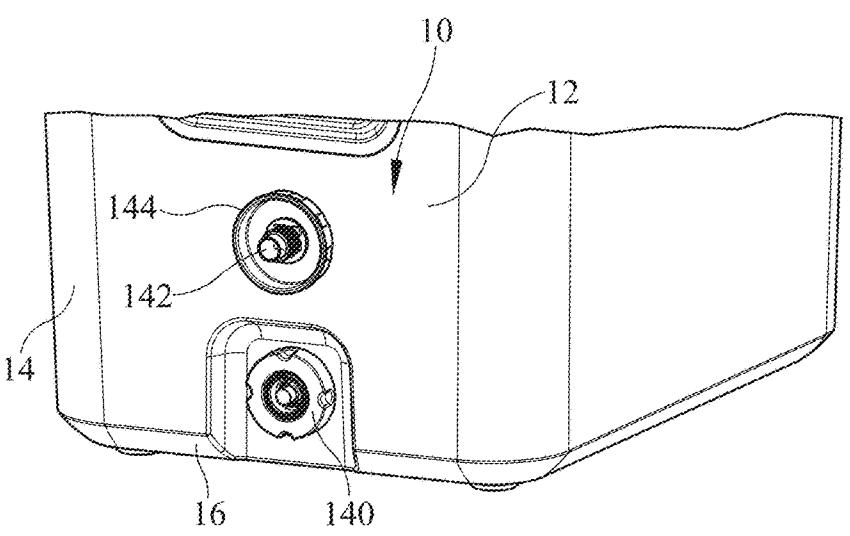
FIG. 13B depicts the drain plug of FIG. 13A in a draining position, according to one or more embodiments shown and described herein.
Figure 13A:
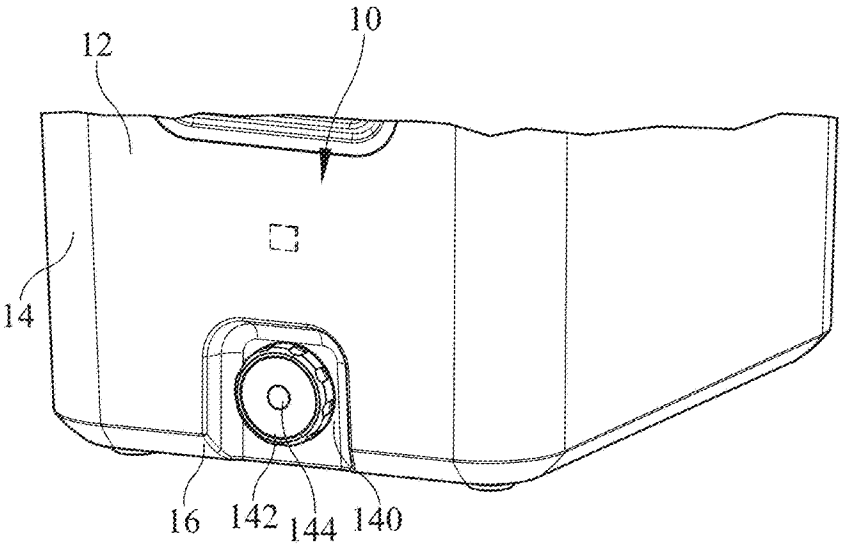
FIG. 13A depicts a drain plug of the insulating container of FIG. 1 in a sealed position, according to one or more embodiments shown and described herein.

Turning now to FIGS. 13A and 13B, the insulating container 10 may further include a drain 140 configured to remove liquid (e.g. melted ice, etc.) from the internal cavity 20 of the insulating container 10. In these embodiments, the drain 140 may be formed within at least one of the walls (e.g., first wall 12*a*, second wall 12*b*, and/or sidewalls 12*c*, 12*d*) of the outer body member 14 and may extend from the outer body member 14 through the liner 18 and into the internal cavity 20.

In these embodiments, the drain 140 may be positioned adjacent the base member 16 of the insulating container 10 (e.g., at a bottom portion of at least one of the walls) and may include a drain channel extending through the drain 140 having a downward and/or negative slope. It should be appreciated that the positioning of the drain and the slope of the drain channel may allow for gravity to direct liquid from the internal cavity 20 and out of the insulating container 10 when the drain 140 is opened.

Referring still to FIGS. 13A and 13B, the drain 140 may further include a drain cap 144 that may be releasably coupled to the drain 140. In these embodiments, the drain plug 142 may form a seal with the drain 140 when the drain cap 144 is secured to the drain 140, such that liquid may not escape from the internal cavity 20 of the insulating container 10 when the drain cap 144 is secured. As depicted in FIGS. 13A and 13B, the drain plug 142 may include a threaded portion for releasably coupling the drain cap 144 to the drain 140. The cap 144 may comprise a plug 142 which may in some embodiments seal the drain 140.

In the embodiments described herein, liquid may escape from the drain 140 when the drain plug 142 is removed and the seal formed between the drain 140 and the drain plug 142 is broken. In these embodiments, the drain plug 142 and the cap 144 may be configured to releasably secure the drain plug 142 to at least a portion of the outer body member 14 while liquid is drained from the internal cavity 20 of the insulating container 10. For example, as depicted most clearly in FIG. 13B, the drain plug cap 144 may include a magnetic surface or insert (shown hidden in broken line) capable of magnetically securing the drain plug cap 144 to the outer body member 14 while the internal cavity 20 of the insulating container 10 is drained. Accordingly, in these embodiments, it should be appreciated that the outer body 14 may further include a magnetic surface, such as a magnetic plate, disposed within the at least one wall 12 on which the drain 140 is dispose, such that the magnetic surface of the drain plug cap 144 may be secured to the outer body member while the internal cavity 20 is drained. Although the drain plug cap 144 is depicted as including a magnetic surface, it should be appreciated that the drain plug cap 144 may utilize any releasable coupling mechanism (e.g., adhesives, Velcro, etc.) to secure the drain plug cap 144 to at least a portion of the outer body member 14 without departing from the scope of the present disclosure.

Figure 14:
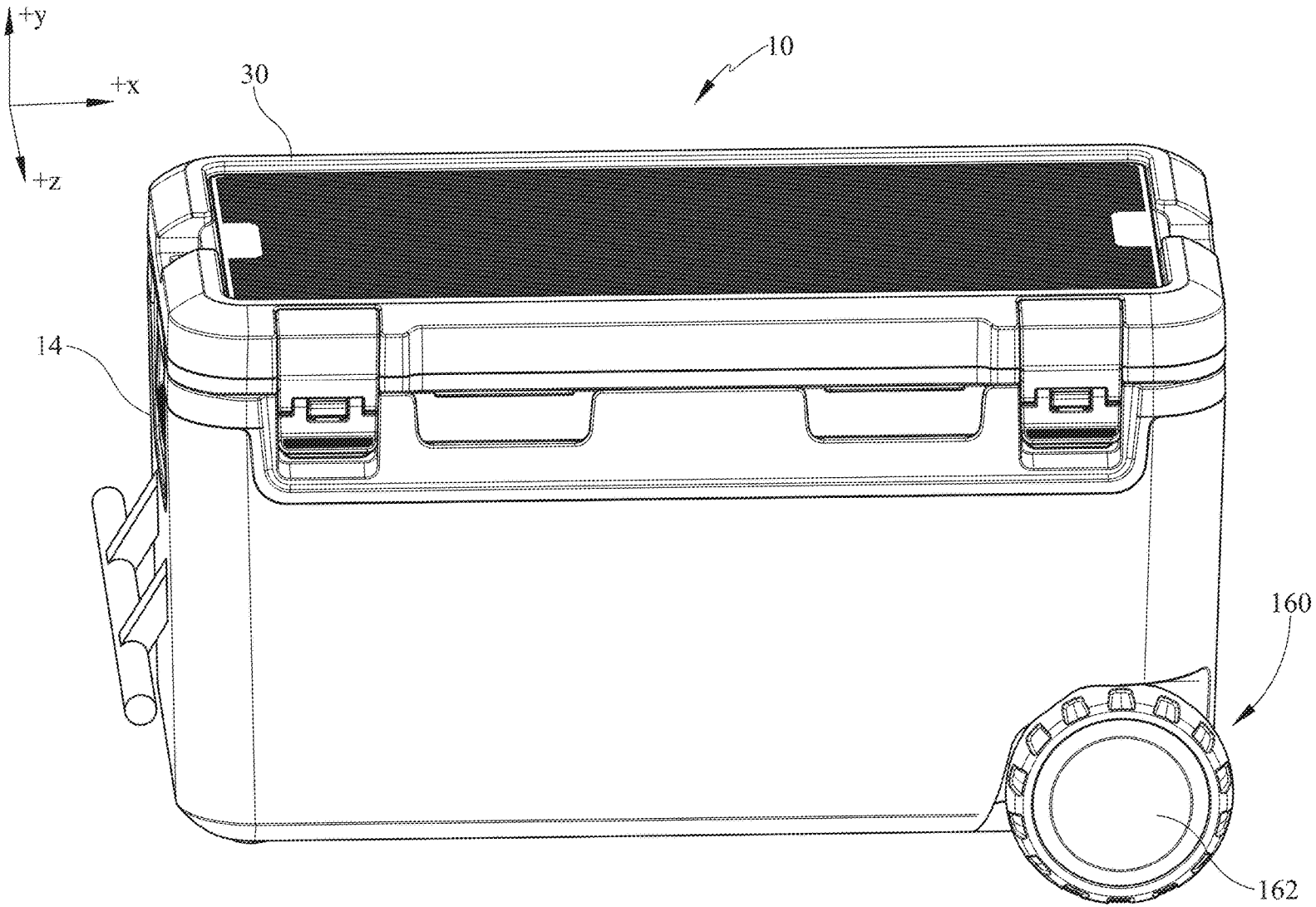
FIG. 14 depicts the insulating container of FIG. 1 including a plurality of wheels, according to one or more embodiments shown and described herein

Referring now to FIG. 14, in some embodiments, the insulating container 10 may further include a wheel assembly 160 that allows for rolled movement and/or support of the insulating container 10. In these embodiments, the wheel assembly 160 may include a plurality of wheels 162, such as a first wheel and a second wheel (although only a single wheel is depicted in FIG. 14). To allow for rolled movement of the insulating container 10, the plurality of wheels 162 may be connected by a single axle or may each have their own independent axle, with each of the plurality of wheels 162 rotating relative the axle upon which it is mounted. In these embodiments, the plurality of wheels 162 may be formed of hard plastic, rubber, or any other similarly wear resistance, high strength material.

To roll the insulating container 10 on the plurality of wheels 162, the insulating container 10 may be pivoted such that a front edge of the insulating container 10 is lifted upwardly (e.g., in the +y-direction as depicted in the coordinate axis of FIG. 14). As the insulating container 10 is pivoted, the weight of the insulating container 10 may be supported by the plurality of wheels 162, at which point the insulating container 10 may be moved.

Although the wheel assembly 160 of FIG. 14 is depicted as including a pair of wheels, it should be appreciated that the wheel assembly 160 may include any number of wheels without departing from the scope of the present disclosure. Furthermore, it should be understood that the positioning of the wheel and/or wheels of the wheel assembly 160 on the insulating container 10 may be dependent on the number of wheels within the wheel assembly 160, as the weight of the insulating container 10 may be distributed and balanced differently based on the number of wheels utilized in the wheel assembly 160.

From the above, it is to be appreciated that defined herein are insulating containers and various features and components for insulating containers. The insulating container described herein may include a plurality of walls that define an outer body member, a base member configured to support the outer body member, a liner disposed within the outer body member and defining an internal cavity, and a lid releasably and pivotally coupled to the outer body member. Furthermore, the lid may be coupled to the outer body member such that the lid is movable between an open position, in which the internal cavity of the insulating container is accessible, and a closed position, in which the lid forms a seal with the outer body member. In these embodiments, the lid may be further pivotable in a first direction and a second direction opposite the first direction to move the lid from the closed position to the open position. The insulating container described herein may further include a latching assembly, which may be configured to releasably secure the lid to the outer body member and allow the lid to pivot in the first direction and the second direction. The latching assembly may include an upper latch member fixedly coupled to the lid, a lower latch member pivotable between a pivoting position and a release position, and a pin member that couples the upper latch member to the lower latch member. In these embodiments the pin member may be received by a knuckle fixedly attached to the outer body member. The latching assembly described herein may allow the lid to move to the open position by pivoting in either the first direction or the second direction, and may further allow for the lid to be fully detached from the outer body member.

Embodiments of the present disclosure may be further described with reference to the following clauses:

Clause 1. An insulating container comprising: a plurality of walls defining an outer body member; a base member configured to support the outer body member, the plurality of walls extending from the base; a liner disposed within and spaced apart from the plurality of walls, the liner defining an internal cavity of the insulating container; a lid releasably and pivotally coupled to the outer body member, the lid being configured to move between an open position in which the internal cavity of the insulating container is accessible and a closed position in which the lid forms a seal with the liner, the lid being pivotable in a first direction and a second direction opposite the first direction to move from the closed position to the open position; a latching assembly configured to releasably secure the lid to the outer body member, the latching assembly comprising: an upper latch member fixedly coupled to the lid; a lower latch member pivotable between a pivoting position and a release position; and a pin member that couples the upper latch member to the lower latch member, the upper latch member being pivotable relative the pin member; and a knuckle fixedly attached to the outer body member and extending between the outer body member and the liner, the knuckle including a seat for receiving the pin member of the latching assembly.

Clause 2. The insulating container of clause 1, wherein the lid is translatable from the closed position to the open position when the lower latch member is in the pivoting position.

Clause 3. The insulating container of clauses 1 or 2, wherein the lid is fully removable from the outer body member when the lower latch member is in the release position.

Clause 4. The insulating container of any of clauses 1-3, wherein the lid further includes a gasket for forming the seal with the liner when the lid is in the closed position.

Clause 5. The insulating container of any of clauses 1-4, wherein the latching assembly includes a plurality of latching assemblies, and the plurality of latching assemblies are disposed on opposing walls of the outer body member.

Clause 6. The insulating container of any of clauses 1-5, wherein the liner further defines a plurality of slots extending longitudinally within the internal cavity.

Clause 7. The insulating container of any of clauses 1-6, further comprising a plurality of partitions received by the plurality of slots, such that the plurality of partitions divide the internal cavity into a plurality of compartments.

Clause 8. The insulating container of any of clauses 1-7, further comprising a first handle component fixedly attached to a first wall of the plurality of walls of the outer body member and a second handle component fixedly attached to a second wall positioned opposite of the first wall.

Clause 9 The insulating container of any of clauses 1-8, wherein the first handle component and the second handle component each include a magnet that couples the first handle component to the second handle component.

Clause 10. The insulating container of any of clauses 1-9, further comprising an insulation material disposed between the outer body member and the liner.

Clause 11. The insulating container of any of clauses 1-10, wherein the latching assembly includes at least a first latching assembly secured to a first side of the outer body member and a second latching assembly secured to a second side of the outer body member opposite the first side.

Clause 12. The insulating container of any of clauses 1-11, wherein, when the lower latch member of the first latching assembly is in the pivoting position and the lower latch member of the second latching assembly is in the release position, the lid pivots in the first direction relative the first latching assembly between the open position and the closed position.

Clause 13. The insulating container of any of clauses 1-3, wherein, when the lower latch member of the second latching assembly is in the pivoting position and the lower latch member of the first latching assembly is in the release position, the lid pivots in the second direction relative the second latching assembly between the open position and the closed position.

Clause 14. The insulating container of any of clauses 1-13, further comprising a cup holder mechanism securable to the outer body member.

Clause 15. The insulating container of any of clauses 1-14, further comprising a drain formed within at least one of the plurality of walls defining the outer body member, the drain extending between the internal cavity and the outer body member.

Clause 16. The insulating container of any of clauses 1-15, further comprising a drain plug configured to be releasably received by the drain and form a seal with the drain.

Clause 17. The insulating container of any of clauses 1-16, wherein the drain plug is magnetically securable to at least a portion of the outer body member when the drain plug is removed from the drain.

Clause 18. The insulating container of any of clauses 1-17, wherein the base member further includes a plurality of wheels fixedly secured to the base member.

Clause 19. The insulating container of any of clauses 1-18, wherein the lower latch member is non-planar with the outer body member and the upper latch member is non-planar with the lid.

Clause 20. An insulating container comprising: a plurality of walls defining a rigid outer body member; a rigid base member configured to support the outer body member; a liner disposed within and spaced apart from the plurality of walls, the liner defining an internal cavity of the insulating container; a lid releasably and pivotally coupled to the rigid outer body member, the lid being configured to move between an open position in which the internal cavity of the insulating container is accessible and a closed position in which the lid forms a seal with the liner; a first latching assembly and a second latching assembly configured to releasably secure the lid to the rigid outer body member, the first latching assembly and the second latching assembly each comprising: an upper latch member fixedly coupled to the lid; a lower latch member pivotable between a pivoting position and a release position; and a pin member that couples the upper latch member to the lower latch member, the upper latch member being pivotable relative the pin member; and a plurality of knuckles fixedly attached to the outer body member and extending between the outer body member and the liner, each of the plurality of knuckles including a seat for receiving the pin member of each of the first latching assembly and the second latching assembly; wherein when the lower latch member of the first latching assembly is in the pivoting position and the lower latch member of the second latching assembly is in the release position, the lid pivots relative the first latching assembly between the open position and the closed position.

Clause 21. The insulating container of clause 20, wherein, when the lower latch member of the second latching assembly is in the pivoting position and the lower latch member of the first latching assembly is in the release position, the lid pivots relative the second latching assembly between the open position and the closed position.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used.

Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Unless otherwise indicated, all numbers expressing quantities of ingredients, properties such as reaction conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

Certain terminology is used in the following description for convenience only and is not limiting. The words "right," "left," "top," and "bottom" designate directions in the figures to which reference is made. The words "a" and "one" are defined as including one or more of the referenced item unless specifically stated otherwise. This terminology includes the words above specifically mentioned, derivatives thereof, and words of similar import. The phrase "at least one" followed by a list of two or more items, such as A, B, or C, means any individual one of A, B or C as well as any combination thereof.

The foregoing description of methods and embodiments has been presented for purposes of illustration. It is not intended to be exhaustive or to limit the teaching to the precise steps and/or forms disclosed, and obviously many modifications and variations are possible in light of the above teaching. It is intended that the scope of the embodiments and all equivalents be defined by the claims appended hereto.

What is claimed is:

1. An insulating container comprising:

a plurality of walls defining an outer body member;

a base member configured to support the outer body member, the plurality of walls extending from the base member;

a liner disposed within and spaced apart from the plurality of walls, the liner defining an internal cavity of the insulating container;

a first handle component fixedly attached to a first wall of the plurality of walls of the outer body member and a second handle component fixedly attached to a second wall positioned opposite of the first wall, wherein the first handle component and the second handle component each include a magnet that couples the first handle component to the second handle component;

a lid releasably and pivotally coupled to the outer body member, the lid being configured to move between an open position in which the internal cavity of the insulating container is accessible and a closed position in which the lid forms a seal with the liner, the lid being pivotable in a first direction and a second direction opposite the first direction to move from the closed position to the open position;

a latching assembly configured to releasably secure the lid to the outer body member, the latching assembly comprising:

an upper latch member fixedly coupled to the lid;

a lower latch member pivotable between a pivoting position and a release position; and a pin member that couples the upper latch member to the lower latch member, the lower latch member being pivotable relative to the pin member; and a knuckle fixedly attached to the outer body member, the knuckle including a seat for receiving the pin member of the latching assembly.

2. The insulating container of claim 1, wherein the lid is translatable from the closed position to the open position when the lower latch member is in the pivoting position.

3. The insulating container of claim 1, wherein the lid is fully removable from the outer body member when the lower latch member is in the release position.

4. The insulating container of claim 1, wherein the lid further includes a gasket for forming the seal with the liner when the lid is in the closed position.

5. The insulating container of claim 1, wherein the latching assembly includes a plurality of latching assemblies, and the plurality of latching assemblies are disposed on opposing walls of the outer body member.

6. The insulating container of claim 1, wherein the liner further defines a plurality of slots extending longitudinally within the internal cavity.

7. The insulating container of claim 6, further comprising a plurality of partitions received by the plurality of slots, such that the plurality of partitions divide the internal cavity into a plurality of compartments.

8. The insulating container of claim 1, further comprising an insulation material disposed between the outer body member and the liner.

9. The insulating container of claim 1, wherein the latching assembly includes at least a first latching assembly secured to a first side of the outer body member and a second latching assembly secured to a second side of the outer body member opposite the first side.

10. The insulating container of claim 9, wherein, when the lower latch member of the first latching assembly is in the pivoting position and the lower latch member of the second latching assembly is in the release position, the lid pivots in the first direction relative the first latching assembly between the open position and the closed position.

11. The insulating container of claim 9, wherein, when the lower latch member of the second latching assembly is in the pivoting position and the lower latch member of the first latching assembly is in the release position, the lid pivots in the second direction relative the second latching assembly between the open position and the closed position.

12. The insulating container of claim 1, further comprising a cup holder mechanism securable to the outer body member.

13. The insulating container of claim 1, further comprising a drain formed within at least one of the plurality of walls defining the outer body member, the drain extending between the internal cavity and the outer body member.

14. The insulating container of claim 13, further comprising a drain plug configured to be releasably received by the drain and form a seal with the drain.

15. The insulating container of claim 14, wherein the drain plug is magnetically securable to at least a portion of the outer body member when the drain plug is removed from the drain.

16. The insulating container of claim 1, wherein the base member further includes a plurality of wheels fixedly secured to the base member.

17. The insulating container of claim 1, wherein the lower latch member is non-planar with the outer body member and the upper latch member is non-planar with the lid.

18. An insulating container comprising:

a plurality of walls defining a rigid outer body member;

a rigid base member configured to support the rigid outer body member;

a liner disposed within and spaced apart from the plurality of walls, the liner defining an internal cavity of the insulating container and further defining said rigid outer body member;

a lid releasably and pivotally coupled to a portion of said liner defining the rigid outer body member, the lid being configured to move between an open position in which the internal cavity of the insulating container is accessible and a closed position in which the lid forms a seal with the liner;

a first latching assembly and a second latching assembly configured to releasably secure the lid to the portion of said liner defining the rigid outer body member, the first latching assembly and the second latching assembly each comprising:

an upper latch member fixedly coupled to the lid;

a lower latch member pivotable between a pivoting position and a release position; and a pin member that couples the upper latch member to the lower latch member, the lower latch member being pivotable relative to the pin member; and a plurality of knuckles fixedly attached to the portion of the liner defining the rigid outer body member, each of the plurality of knuckles including a seat for receiving the pin member of each of the first latching assembly and the second latching assembly;

wherein when the lower latch member of the first latching assembly is in the pivoting position and the lower latch member of the second latching assembly is in the release position, the lid pivots relative the first latching assembly between the open position and the closed position.

19. The insulating container of claim 18, wherein, when the lower latch member of the second latching assembly is in the pivoting position and the lower latch member of the first latching assembly is in the release position, the lid pivots relative the second latching assembly between the open position and the closed position.

20. An insulating container comprising:

a plurality of walls defining an outer body member;

a base member configured to support the outer body member, the plurality of walls extending from the base member;

a liner disposed within and spaced apart from the plurality of walls, the liner defining an internal cavity of the insulating container;

a drain formed within at least one of the plurality of walls defining the outer body member, the drain extending between the internal cavity and the outer body member, a drain plug configured to be releasably received by the drain and form a seal with the drain, wherein the drain plug is magnetically securable to at least a portion of the outer body member when the drain plug is removed from the drain;

a lid releasably and pivotally coupled to the outer body member, the lid being configured to move between an open position in which the internal cavity of the insulating container is accessible and a closed position in which the lid forms a seal with the liner, the lid being pivotable in a first direction and a second direction opposite the first direction to move from the closed position to the open position;

a latching assembly configured to releasably secure the lid to the outer body member, the latching assembly comprising:

an upper latch member fixedly coupled to the lid;

a lower latch member pivotable between a pivoting position and a release position; and a pin member that couples the upper latch member to the lower latch member, the lower latch member being pivotable relative to the pin member; and a knuckle disposed on the exterior of the insulating container, the knuckle including a seat for receiving the pin member of the latching assembly.

21. The insulating container of claim 1, wherein said liner further defines a portion of said outer body member.

22. The insulating container of claim 20, wherein said liner further defines a portion of said outer body member.

* * * * *